US008210641B2

(12) United States Patent
Eguchi et al.

(10) Patent No.: US 8,210,641 B2
(45) Date of Patent: Jul. 3, 2012

(54) LIQUID EJECTION HEAD, LIQUID EJECTION APPARATUS, AND MANUFACTURING METHOD OF LIQUID EJECTION HEAD

(75) Inventors: Takeo Eguchi, Kanagawa (JP); Shogo Ono, Kanagawa (JP); Kazuyasu Takenaka, Tokyo (JP); Atsushi Nakamura, Kanagawa (JP); Yuichiro Ikemoto, Kanagawa (JP); Shigeyoshi Hirashima, Kanagawa (JP); Atsushi Nakayama, Kanagawa (JP); Shota Nishi, Kanagawa (JP); Yuji Yakura, Kanagawa (JP); Shigeyoshi Fujiki, Kanagawa (JP); Manabu Matsuda, Kanagawa (JP)

(73) Assignee: Sony Corporation, Tokyo (JP)

( * ) Notice: Subject to any disclaimer, the term of this patent is extended or adjusted under 35 U.S.C. 154(b) by 784 days.

(21) Appl. No.: 12/264,772

(22) Filed: Nov. 4, 2008

(65) Prior Publication Data

US 2009/0056768 A1 Mar. 5, 2009

Related U.S. Application Data

(62) Division of application No. 11/443,958, filed on May 31, 2006, now Pat. No. 7,581,809.

(30) Foreign Application Priority Data

Jun. 2, 2005 (JP) ..... 2005-162340
Aug. 17, 2005 (JP) ..... 2005-237000
Aug. 29, 2005 (JP) ..... 2005-248291

(51) Int. Cl.
*B41J 2/165* (2006.01)

(52) U.S. Cl. ..... 347/22; 347/29; 347/33

(58) Field of Classification Search ..... None
See application file for complete search history.

(56) References Cited

U.S. PATENT DOCUMENTS 6,604,811 B2 * 8/2003 Sawicki ..... 347/33
2005/0007412 A1 * 1/2005 Nishikawa et al. ..... 347/33

FOREIGN PATENT DOCUMENTS

| | | |
|---|---|---|
| JP | 57-034969 | 2/1982 |
| JP | 2645271 | 2/1982 |
| JP | 64-057126 | 3/1989 |
| JP | 04-185450 | 7/1992 |
| JP | 07-164627 | 6/1995 |
| JP | 2000-079693 | 3/2000 |
| JP | 2000-203031 | 7/2000 |
| JP | 2005-104143 | 4/2001 |
| JP | 2001-138528 | 5/2001 |
| JP | 2002-052717 | 2/2002 |
| JP | 2002-234167 | 8/2002 |
| JP | 2002-240272 | 8/2002 |

(Continued)

*Primary Examiner* — Matthew Luu
*Assistant Examiner* — Erica Lin
(74) *Attorney, Agent, or Firm* — Robert J. Depke; Rockey, Depke & Lyons, LLC

(57) ABSTRACT

A liquid ejection head includes an energy-generating element arranged on a semiconductor substrate, a barrier layer deposited on the semiconductor substrate for forming a liquid chamber in the periphery of the energy-generating element, and a nozzle sheet bonded on the barrier layer and having a nozzle formed at a position opposing the energy-generating element, in which the liquid ejection head ejects liquid contained in the liquid chamber from the nozzle as liquid droplets by the energy-generating element, and the barrier layer is provided with a plurality of depressions, each having an independent contour, arranged within a range, which is separated from the border of the barrier layer, on an adhesive region adhering to the nozzle sheet.

12 Claims, 28 Drawing Sheets

FOREIGN PATENT DOCUMENTS

| | | |
|---|---|---|
| JP | 2002-240309 | 8/2002 |
| JP | 2002-296921 | 10/2002 |
| JP | 2004-090407 | 3/2004 |
| JP | 2004-142450 | 5/2004 |
| JP | 2004-209664 | 7/2004 |
| JP | 2005-022193 | 1/2005 |
| JP | 2005-022200 | 1/2005 |
| JP | 2005-022317 | 1/2005 |
| JP | 2005-138498 | 6/2005 |
| JP | 2005-153183 | 6/2005 |
| JP | 2005-153185 | 6/2005 |
| JP | 2005-193624 | 7/2005 |

* cited by examiner

ORTHOGONAL ARRANGEMENT/
NON-CONTACT

ORTHOGONAL ARRANGEMENT/
CONTACT

HEXAGONAL LATTICE
ARRANGEMENT/
CONTACT

EXAMPLE 1: Λ=82%

EXAMPLE 2: Λ=60%

FIG. 5A

SPECIFICATIONS

| | CONVENTIONAL EXAMPLE | EXAMPLE 1 | EXAMPLE 2 |
|---|---|---|---|
| HEAD CHIP SIZE | 1.6×1.6 ($mm^2$) | | |
| ADHESIVE AREA | 1.4×16 ($mm^2$) | | |
| BARRIER LAYER THICKNESS | 11 ($\mu$m) | | |
| ADHESIVE AREA RATIO ($\Lambda$) | 100% | 82% | 60% |
| P | — | 82.4 ($\mu$m) | |
| Q | | 82.4 ($\mu$m) | |
| HOLE DIAMETER (=2R) | | 40 ($\mu$m) | 60 ($\mu$m) |
| MINIMUM BARRIER WIDTH | | 42.4 ($\mu$m) | 22.4 ($\mu$m) |

FIG. 5B

MANUFACTURING CONDITIONS

| (1) NOZZLE SHEET/ FRAME BONDING | | | (2) HEAD CHIP/ NOZZLE SHEET BONDING | | | (3) BARRIER LAYER CURING | |
|---|---|---|---|---|---|---|---|
| TEMPERATURE (°C) | PRESSURE (Kg/FRAME) | TIME (SEC) | TEMPERATURE (°C) | PRESSURE (Kg/HEAD CHIP) | TIME (SEC) | TEMPERATURE (°C) | TIME (MIN) |
| 150±5 | 20 | 300 | 140±5 | 15 | 10 | 140±5 | 240±10 |

LIQUID EJECTION HEAD, LIQUID EJECTION APPARATUS, AND MANUFACTURING METHOD OF LIQUID EJECTION HEAD

CROSS REFERENCES TO RELATED APPLICATIONS

The subject matter of application Ser. No. 11/443,958, is incorporated herein by reference. The present application is a Divisional of U.S. Ser. No. 11/443,958, filed May 31, 2006, which claims priority to Japanese Patent Application JP 2005-162340 filed in the Japanese Patent Office on Jun. 2, 2005, JP 2005-237000 filed in the Japanese Patent Office on Aug. 17, 2005, and JP 2005-248291 filed in the Japanese Patent Office on Aug. 29, 2005, the entire contents of which are incorporated herein by reference.

BACKGROUND OF THE INVENTION

1. Field of the Invention

The present invention relates to a liquid ejection head for ejecting liquid within liquid chamber as liquid droplets by an energy generating element, a liquid ejection apparatus, and a manufacturing method of the liquid ejection head, and in particular it relates to a technique for improving the overall adhesion force of a nozzle sheet having nozzles formed thereon.

2. Description of the Related Art

A liquid ejection apparatus represented by an inkjet printer generally includes a liquid ejection head (simply referred to as a head below) composed of a head chip having barrier layers deposited for forming a liquid chamber on a semiconductor substrate and a nozzle sheet having a number of nozzles arranged thereon. Then, by the energy generating element, liquid in the liquid chamber is ejected from the nozzle as liquid droplets. Thus, the head includes a liquid chamber part where the head chip and the nozzle sheet exist with liquid therebetween and an integrated coherent part of both members. In general, the head chip and the nozzle sheet are separately manufactured, and they are bonded together at back end steps of the head assembling.

FIG. 30 is a partial perspective view of a head 30 of such a conventional inkjet printer. In FIG. 30, for description convenience sake, a head chip 301 is exploded from a nozzle sheet 306 and they are shown in a state vertically reversed to the service condition.

Referring to FIG. 30, the head chip 301 is composed of a semiconductor substrate 302 and a barrier layer 303. That is, on the semiconductor substrate 302, heater elements 304 (energy generating elements) and also their drive circuits (not shown) depending on circumstances are formed by a photomechanical process. On the upper surface of the semiconductor substrate 302 other than vicinities of the heater elements 304, ink chambers 305 and ink passages are formed while the barrier layer 303 is deposited for bonding the nozzle sheet 306 by the same photomechanical process. On an adhesive area on the upper barrier layer 303, the nozzle sheet 306 having a number of nozzles 306*a* positioned according to the arrangement of the heater elements 304 is bonded to form a thermal head 300 shown in FIG. 30.

The nozzle sheet 306 is generally made of a metal, such as electrocast nickel, or a polymer film such as a polyimide film.

SUMMARY OF THE INVENTION

When bonding the nozzle sheet 306 made of such a material on the barrier layer 303, an insufficient adhesive surface force becomes a problem. That is, by the heating of the heater elements 304 during ink ejection, a stress is applied to the adhesive surface due to the difference of the thermal expansion coefficient between the barrier layer 303 and the nozzle sheet 306; during ink ejection, large changes in pressure are repeated to the ink chambers 305; and a large mechanical pressure is repeatedly applied to the nozzle sheet 306 by cleaning operation in which an ejection surface (upper surface in FIG. 30) of the nozzle sheet 306 is rubbed with a wiper or a roller. Thereby, the adhesion force is gradually reduced, so that the nozzle sheet 306 may be peeled off the barrier layer 303.

Hence, the strength of the adhesive surface between the barrier layer 303 and the nozzle sheet 306 is important. In order to improve the insufficient strength, the effective means generally are: (1) a material with excellent adhesive performances is used for the barrier layer 303; (2) the adhesive performances are improved by controlling (removing contaminants, oil films, and oxide films) the adhesive surface between the barrier layer 303 and the nozzle sheet 306; (3) the adhesion condition during bonding is improved by controlling the temperature; (4) the flatness of the adhesive surface between them is sufficiently secured; and (5) an appropriate pressure is applied on the adhesive surface between them on average during boding.

However, regarding to the item (1), materials available for the barrier layer 303 are extremely limited, so that there is scarce room for selecting the material. Also, as for items (2) and (3), the control has been conventionally performed perfectly; there is scarce room for further improvement. Thus, the means of items (4) and (3) remain for improvement in structure; however, there are problems presently as follows.

First, in the flatness of the adhesive surface during general bonding, a liquid adhesive with flowability is sandwiched between the surfaces, so that although the flatness has a slight problem, the adhesive permeates and moves when the surfaces are pressurized during bonding. As a result, the clearances due to the insufficient flatness of the adhesive surface are absorbed as thickness unevenness of the adhesive.

However, in the bonding between the barrier layer 303 and the nozzle sheet 306, such a general bonding mechanism does not work. That is, the barrier layer 303 deposited on the semiconductor substrate 302 has adhesiveness when being heated at a suitable temperature but it has not enough flowability unlike in a general adhesive although the surface of the barrier layer 303 has some flexibility at that temperature. Accordingly, even a pressure is applied on the nozzle sheet 306, the clearances due to the insufficient flatness of the adhesive surface remain without being bonded.

Moreover, the adhesive surface between the barrier layer 303 and the nozzle sheet 306 cannot be uniformly flattened. That is, portions where the ink chambers 305 and ink passages are formed obviously have corrugations due to grooves for passing ink, and even in portions other than those, for the existence of intersections of wirings, transistors, and connection electrodes on the semiconductor substrate 302, slight corrugations are generated on the barrier layer 303, so that the surface is not perfectly flat. If such slight unevenness is increased larger than a predetermined value so that the unevenness cannot be absorbed by the surface flexibility and deflection of the nozzle sheet 306 when the barrier layer 303 is heated during the bonding, nonuniformity in adhesive strength and adhesion failure are generated.

A method for solving the problem includes increasing the flexibility of the barrier layer 303 by increasing the thickness of the barrier layer 303; however, as shown in FIG. 30, this thickness also is a factor for determining the height of the ink chambers 305, so that the thickness cannot be arbitrarily selected. In particular, in order to miniaturize the liquid droplet in size for corresponding to the recent demand for high-quality images, the hole diameter of the nozzle 306*a* is reduced and the height of the ink chambers 305, half of which is occupied by the thickness of the barrier layer 303, is decreased. Hence, the thickness of the barrier layer 303 needs to be reduced for miniaturizing the size of the liquid droplet. As a result, not only the flexibility of the barrier layer 303 is reduced but also steps on the semiconductor substrate 302 are apt to rise to the surface of the barrier layer 303.

Secondly, as for the pressurizing the surfaces, it is demanded that portions to be bonded are generally fixed during bonding while a predetermined pressure is applied thereto until the adhesive is solidified. The reason is that the adhesive can be uniformly spread over the whole area as thinly as possible because the adhesive is liquid in general boding, as well as that even when bubbles are involved, so that the pressure must push these bubbles out of the bonding surface.

However, as mentioned above, the bonding between the barrier layer 303 and the nozzle sheet 306 is not only different from that using a liquid adhesive but also as the material for use in the barrier layer 303 has scarce flexibility, a certain pressure is needed to have a requisite strength. On the other hand, with increasing pressure applied thereto, the possibility of damage of the semiconductor substrate 302 and the barrier layer 303, and bad influence on characteristics of the head 300 increase. Depending on other conditions such as the surface flatness and the surface state, even if the pressure is increased, the sufficient adhesive strength may not be obtained.

In such a manner, even when the material selection, the surface control, and the temperature control of the barrier layer 303 are preferably performed, the problem is how to bring adhesive surfaces in contact together, so that a thing in not contact with the adhesive surface cannot be bonded. That is, the basic of bonding is the close contact of a bonding material with a material to be bonded. Moreover, in order to obtain a certain adhesive strength, the coherent surface must occupy a certain percentage of the whole adhesive surface.

In particular, the bonding of a flat surface with a large area is very difficult, so that if slight unevenness exists on the surface of the barrier layer 303 or the nozzle sheet 306, air is involved in that portions or the sufficient pressure cannot be applied thereto, so that the bonding becomes imperfect due to the insufficient adherence. Thus, there is no solving means other than that while reducing the unevenness of the surface of the barrier layer 303 as small as possible, the remaining unevenness has to be absorbed by deflecting the nozzle sheet 306 so as to bring it in close contact with the barrier layer 303 or by other some means.

Then, in order to solve such bonding problems, as is disclosed in Japanese Patent No. 2645271, a technique is known in that a thin sheet with flexibility (flexible sheet) is sandwiched between the barrier layer 303 and the nozzle sheet 306 so that the nozzle sheet 306 is deflected to follow the unevenness of the surface of the barrier layer 303 and adhere thereon while being pressurized.

However, the technique described in the above-mentioned Japanese Patent No. 2645271 has a problem that a flexible sheet is additionally required. Also, since the quality control of the flexible sheet itself and steps for sandwiching the flexible sheet are needed, the productivity of the head is deteriorated. Thus, the technique cannot cope with the recent demand for reducing the price of the inkjet printer.

On the other hand, in such an inkjet printer, the printing operation may not be continuously performed for a long time, and when ink is not ejected from the ink ejection nozzle of the print head, ink adhered to the vicinity of the ink ejection nozzle at the preceding printing may be solidified by being evaporated and dried, which may induce a difficulty in normal ink ejection.

Therefore, as described above, the print head is conventionally cleaned by abutting a blade made of slightly hard rubber on the ink ejection surface of the print head so as to slide it over the ink ejection surface for wiping out the solidified ink adhered on the ink ejection surface. In relation with this, Japanese Unexamined Patent Application Publication No. 57-34969 discloses a technique for further improving the wiping effect by rotating a plurality of blades attached to a rotating shaft.

However, in such conventional techniques, the ink adhered on the ink ejection surface is wiped out by abutting the blade made of slightly hard rubber on the ink ejection surface of the print head so as to slide it over the ink ejection surface, so that a large force is applied to the ink ejection surface, which may lead to damage of the ink ejection surface. Also, the cleaning with the blade has to depend only on the wiping effect; however, only by the wiping, ink may remain on the ink ejection nozzle. Even when using a plurality of the blades, there has been the same problem as above.

Also, regarding to the cleaning, Japanese Unexamined Patent Application Publication No. 2002-240309 discloses a technique for cleaning ink and contaminants adhered on the ink ejection surface of the print head by providing a cleaning roller for the cleaning within a head cap for protecting the ink ejection surface of the print head.

However, such an inkjet printer includes only the cleaning roller within the head cap, so that the residual ink in the ink ejection nozzle with increased viscosity is insufficiently sucked, which may cause instable ink-ejection performances due to remaining ink dregs with increased viscosity and contaminants such as paper dust.

Furthermore, Japanese Unexamined Patent Application Publication No. H04-185450 describes an improved cleaning device in that a cleaning roller is formed of an elastic porous material. However, when using such a cleaning roller, since not only residual ink on the ink ejection nozzle but also ready-to-ejection ink within the ink ejection head may be sucked, so that the ink consumption is increased if the cleaning roller is heavily used consistently, which may lead to reduction in suction performances and in life of the cleaning roller.

Accordingly, it is desirable to provide a liquid ejection head, a liquid ejection apparatus, and a manufacturing method of the liquid ejection head capable of achieving a necessary adhesive strength and adhesive uniformity with a pressure within a suitable range without anxiety over damage and also being capable of corresponding to the improvement of image quality due to miniaturizing liquid droplets as well as being excellent in productivity.

Furthermore, it is also desirable to provide a cleaning device of a liquid ejection head capable of securely removing ink and contaminants adhered to the liquid ejection head as well as ensuring the life of the product.

BRIEF DESCRIPTION OF THE DRAWINGS

FIGS. 5A and 5B are tables showing the specification and manufacturing conditions of the head according to the embodiment;

DESCRIPTION OF THE PREFERRED EMBODIMENTS

Embodiments of the present invention for solving the problems described above will be described below with reference to the drawings.

A liquid ejection head according to the present invention is equivalent to a head 10 of an inkjet printer according to an embodiment below-mentioned. According to the embodiment, the liquid ejected from the head 10 is ink; a liquid chamber for containing ink is an ink chamber 15; and the micro amount (several pico litters, for example) of the ink ejected from a nozzle 16*a* is an ink droplet. Furthermore, according to the embodiment, a heating element 14 is used as an energy generating element. The heating element 14 is precipitated on one face of a semiconductor substrate 12 to form one face (bottom wall) of the ink chamber 15. A liquid ejection apparatus according to the present invention is equivalent to a thermal inkjet printer having such a head 10 according to the embodiment.

Figure 1:
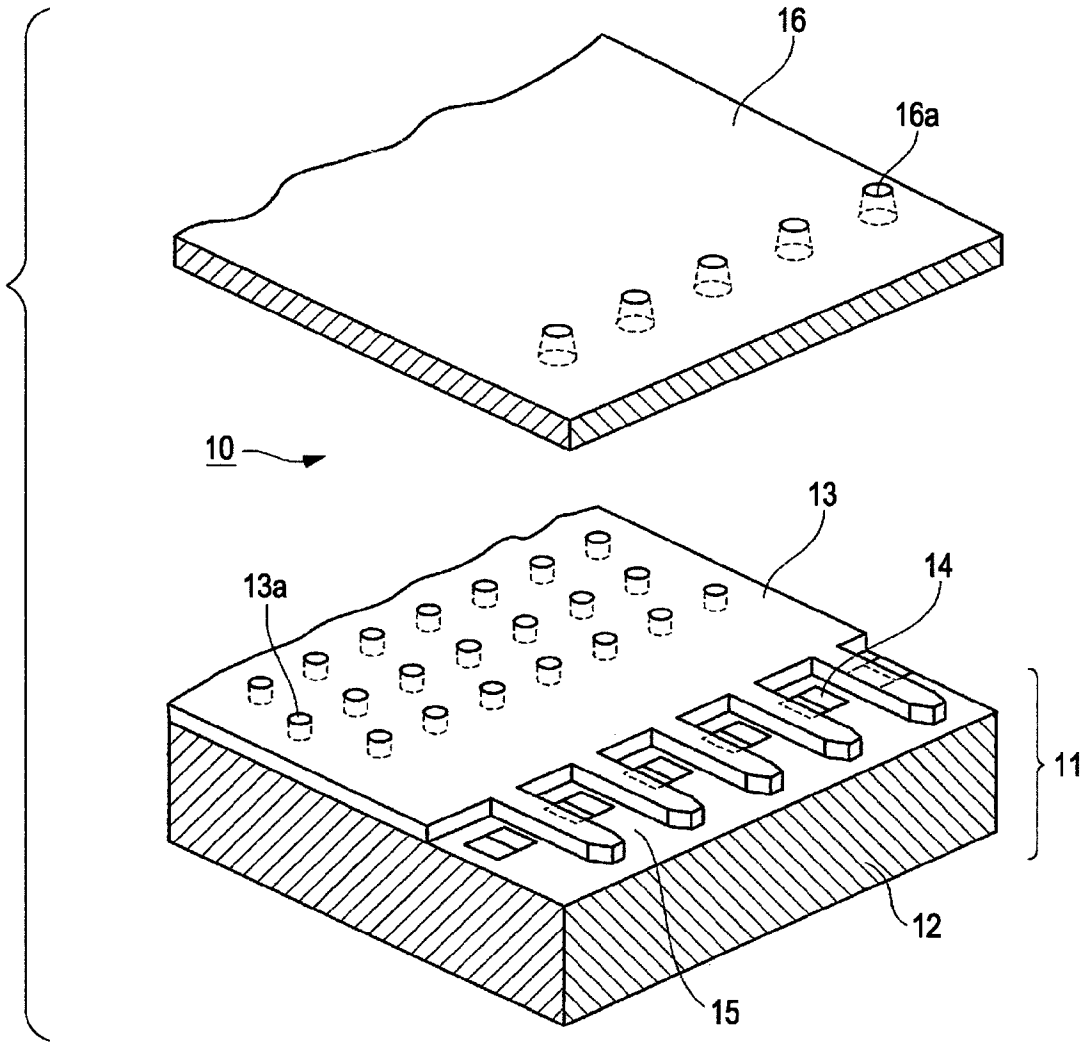
FIG. 1 is a partial perspective view of a head according to an embodiment.

FIG. 1 is a partial perspective view of the head 10 according to the embodiment. In FIG. 1, for description convenience sake, a head chip 11 is exploded from a nozzle sheet 16 and they are shown in a state vertically reversed to the service condition.

Figure 2:
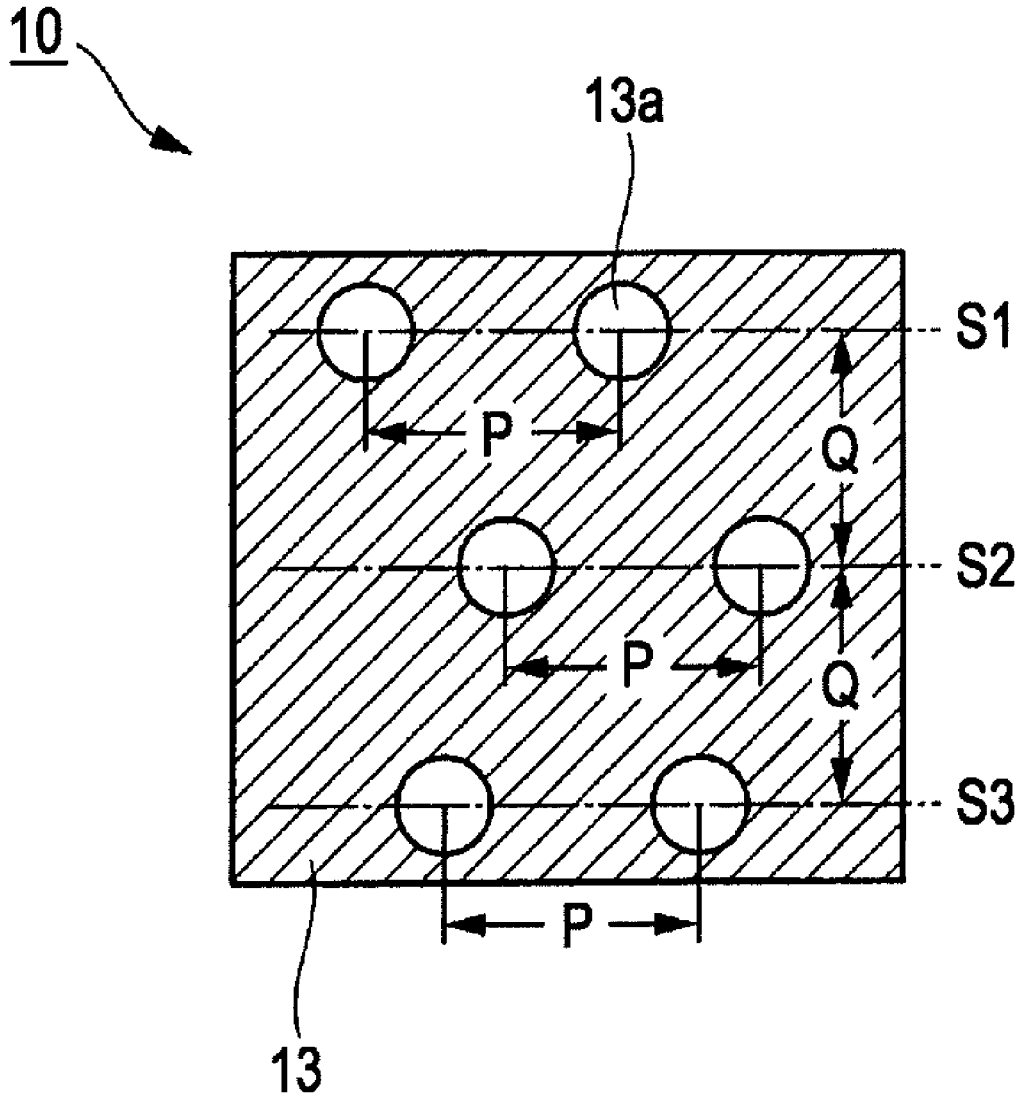
FIG. 2 is a partial plan view of a surface (adhesive region) of a barrier layer in the head according to the embodiment.

FIG. 2 is a partial plan view showing the surface of a barrier layer 13 (adhesive region) of a barrier layer 13 in the head 10 according to the embodiment.

Referring to FIG. 1, the head 10 is composed of a head chip 11 and a nozzle sheet 16. That is, the head chip 11 is composed of a semiconductor substrate 12 having heating elements 14 arranged thereon and a barrier layer 13 for forming ink chambers 15, and on the surface (adhesive region) of the barrier layer 13, the nozzle sheet 16 having nozzles 16*a* formed thereon is to be bonded.

The semiconductor substrate 12 made of silicon, as shown in FIG. 1, includes a plurality of the heating elements 14. The heating element 14 is precipitated on one face (upper face in the drawing) of the semiconductor substrate 12 to form two parts, each having the length larger than the width. The two divided parts of the heating element 14 are electrically connected to external circuits, respectively, via wiring and electrodes (not shown) formed on the semiconductor substrate 12.

The barrier layer 13 is formed by depositing a photosensitive cyclized-rubber resist with a thickness of 10 μm on the surface of the semiconductor substrate 12 on the heating element 14 side. The barrier layer 13 sectionalizes a plurality of the heating elements 14 while maintaining the space between each heating element 14 and the nozzle sheet 16. Thus, the semiconductor substrate 12, each heating element 14, and the nozzle sheet 16 form each ink chamber 15, in which the semiconductor substrate 12 and each heating element 14 form the top wall of the ink chamber 15; the barrier layer 13 forms three side walls of the ink chamber 15; and the nozzle sheet 16 forms the bottom wall of the ink chamber 15.

Furthermore, the nozzle sheet 16 is made of electrocast nickel so as to have a plurality of the nozzles 16*a* formed at positions opposing each heating element 14. The nozzle sheet 16 is precisely positioned so that the position of each nozzle 16*a* coincides with that of each heating element 14. Then, the nozzle sheet 16 is bonded on the surface (adhesive region) of the barrier layer 13 by applying a pressure of 10 to 15 kg (0.39 to 0.59 kg/mm$^2$) thereto in a state of the head chip 11 with a size of 1.6 mm×1.6 mm and heated at 130° C.

The bonding process is as follows: on a heated head-mount surface plate, the nozzle sheet 16 bonded on a ceramic frame is placed; the semiconductor substrate 12 (the head chip 11) having the pre-heated barrier layer 13 deposited thereon is placed by adjusting its position to those of the nozzles 16*a* of the nozzle sheet 16. Then, a pressure is applied from the back surface of the head chip 11 toward the surface plate, and it is maintained for a predetermined time. Hence, the bonding process is sequentially performed by turning the direction upside down to FIG. 1, so that on the large area nozzle sheet 16, a number of the head chips 11 are bonded by arranging them in the width direction of a photographic sheet (not shown) to form the line-type head 10 having a line-head share of a photographic width.

In order to print images by an inkjet printer having such a head 10, ink is supplied to each ink chamber 15 from an ink tank (not shown) via an opened region shown at the lower right of FIG. 1. On the basis of a printing command, a pulse current is passed through the two parts of the heating element 14 for a short time (1 to 3 μseconds, for example) so as to rapidly heat the heating element 14. Then, ink bubbles are generated in the ink being in contact with the heating element 14 so that a certain volume of ink is displaced by the inflation of the bubbles. As a result, this generates an ejection pressure so that the same amount of ink as that of the displaced ink is ejected from the nozzle 16*a* as liquid droplets so as to land on a photographic sheet (not shown) for forming characters or images. The two parts of the heating element 14 enable ink to have deflecting ejection.

For ejecting ink, the heating element 14 needs to be heated in such a manner, and this heating also generates a stress due to the expansion difference between both materials in the adhesive surface. Also, during ink ejection, large changes in pressure are repeatedly applied to the ink chamber 15. Furthermore, when the ejection surface (upper surface in FIG. 1) of the nozzle sheet 16 is rubbed with a wiper or roller for cleaning, a mechanical pressure is repeatedly applied to the nozzle sheet 16.

Thus, if the adhesive strength between the barrier layer 13 and the nozzle sheet 16 is insufficient, the nozzle sheet 16 may be peeled off the barrier layer 13. Hence, it is necessary to closely stick the nozzle sheet 16 onto the barrier layer 13 by applying a pressure for securing sufficient adhesive strength.

However, since the silicon semiconductor substrate 12 may scarcely be deflected in principle, the deflection of the semiconductor substrate 12 is almost zero even when the pressure is applied. Also, the total thickness of the barrier layer 13 is about 10 μm, so that the barrier layer 13 is scarcely deflected. Therefore, if the flatness of the surface (adhesive region) of the barrier layer 13 is very slightly impaired, the pressure distribution becomes uneven, so that bubbles are enclosed within a local cavity if it has a size of several tenth μm or more. In particular, when the nozzle sheet 16 with a relatively large area is bonded to the head chip 11, cavities may be possibly generated, so that the perfect bonding is difficult.

In order to bond (stick) the barrier layer 13 to the nozzle sheet 16 by solving such problems, not by the physical bonding evenly over the entire adhesive region, but conversely, by positively providing non-adhesive air-gap portions in a predetermined ratio so that the entire portions other than the air-gap portions may securely adhere by reducing projections. To this end, the head 10 according to the embodiment, as shown in FIGS. 1 and 2, is provided with a plurality of depressions 13*a*, each having an independent contour. Then, the depression 13*a* of the barrier layer 13 will be described in detail.

As shown in FIG. 1, the barrier layer 13 forms side walls of the ink chamber 15 and the thickness (about 8 to 11 μm, generally, and about 10 μm according to the embodiment) of the barrier layer 13 determines the height of the ink chamber 15. In general, portions of the surface of the barrier layer 13 other than the ink chambers 15 and ink flow paths are continuously flat, and as a few exceptions, sporadic holes (holes for exposing electrodes, for example) are only provided if necessary. In such a manner, by providing a plurality of the depressions 13*a* on the surface (adhesive region) of the barrier layer 13 where is continuously flat in general, the effective adhesive area is reduced.

However, by providing the depressions 13*a*, advantages are offered as follows: (1) since the depression 13*a* is not brought into contact with the nozzle sheet 16, projections, which may exist in this portion, are eliminated, so that the probability that other portions closely adhere by the pressurizing during the bonding is increased; (2) when a predetermined pressure is applied during the bonding, the contact pressure is increased by the reduction in contact area; (3) if the contact pressure is increased, even the thickness of the barrier layer 13 is the same, the deflection is increased, so that the adherence in the adhesive region is increased; (4) the adhesive conditional difference between portions of the ink chambers 15 and ink flow paths and portions other than those is reduced, so that the adhesive conditions over the entire head chip 11 are approximated; (5) since the depressions 13*a* are independent from each other, even if the barrier wall arranged adjacent to the ink chamber 15 and the ink flow path is accidentally defective, and ink leaks in one depression 13*a*, the ink cannot continuously leak in other depressions 13*a*; and (6) when the nozzle sheet 16 is bonded at the maximum temperature in the head manufacturing process so as to have a temperature higher than that in the entire manufacturing process after the bonding, and in use, the volume of air enclosed in the depressions 13*a* is reduced, so that the nozzle sheet 16 can be sucked by vacuum and the negative pressure is applied in addition to the adhesive force so as to increase the overall adhesive force.

By providing a plurality of the depressions 13*a*, each having an independent contour, in such a manner, the adherence between the barrier layer 13 and the nozzle sheet 16 is strongly secured. The depressions 13*a* are provided within a region separated from the border of the barrier layer 13 so as not to overlap with the ink chambers 15 and the ink flow paths.

Since the depression 13*a* may function as a cavity, any concave portion may work principally. However, the shape of the depression 13*a* may have ones not capable of being achieved due to a fabricating method as well as ones cannot sufficiently display the expected performances although the fabrication has no problem.

In the head 10 according to the embodiment and shown in FIGS. 1 and 2, in view of such considerations, each depression 13*a* cuts through the barrier layer 13 from the bonding surface to the nozzle sheet 16 to the depositing surface on the semiconductor substrate 12. Hence, not only the fabrication is simple, but also since the semiconductor substrate 12 is attracted to the nozzle sheet 16 via the depression 13*a* with the vacuum, the overall adhesive strength of the head 10 is increased.

When the contour of the depression 13*a* has a concave shape (an asteroid curve, for example) or a polygonal shape such as a triangle, a mathematical discontinuous point (graphic apex) exists in the shape, so that when residual air in the depression 13*a* is reduced in pressure (20 to 30% lower than the atmospheric pressure) due to the reduction in temperature, a pressure applied to the vicinity of the discontinuous point extremely increases, which may lead to the non-uniform adhesive strength. Therefore, in the head 10 shown in FIGS. 1 and 2 according to the embodiment, the depression 13*a* is circular.

The shape of the depression 13*a* is not limited to a circle and any shape may be adopted as long as it offers a function expected to the depression 13*a*. Preferably, in addition to a circle, the shape may be elliptic (inside contour is positively curved), oval and polygonal with rounded corners (inside contour is combined of a positive curve and a straight line), or pentagonal or higher-order polygonal (all the apexes inside contour are obtuse). These shapes widely disperse the strain concentrated in the vicinity of the apex when the pressure in the depression 13*a* becomes negative.

Furthermore, in the head 10 according to the embodiment and shown in FIGS. 1 and 2, the contour shapes and volumes of all the depressions 13*a* are the same. Hence, the adhesive conditions are uniform on the surface (adhesive region) of the barrier layer 13. In addition, "the same" includes errors in fabricating the depression 13*a* and slight errors and strains due to various disturbances in the manufacturing stage.

Then, in the arrangement of the depressions 13*a*, as shown in FIG. 2, on virtual parallel lines (S1, S2, S3, . . . ) arranged at constant intervals of Q, the depressions 13*a* with a circumscribed radius R are arrange at predetermined intervals of P. At this time, in order to have an independent contour, which is not overlapped with each other, for each depression 13*a*, a condition of P>2R has to be satisfied.

In order to unify the distance between the depressions 13*a* so as to increase the adhesive uniformity, the depression 13*a* is arranged at an apex of an equilateral triangle in the head 10 according to the embodiment and shown in FIGS. 1 and 2. However, it is not limited to the equilateral triangle, so that if the depressions 13*a* are arranged so as to satisfy a condition of $P \geqq Q \geqq ((\sqrt{3})/2)P$, substantially uniform adhesive strength can be obtained.

Figure 3A:
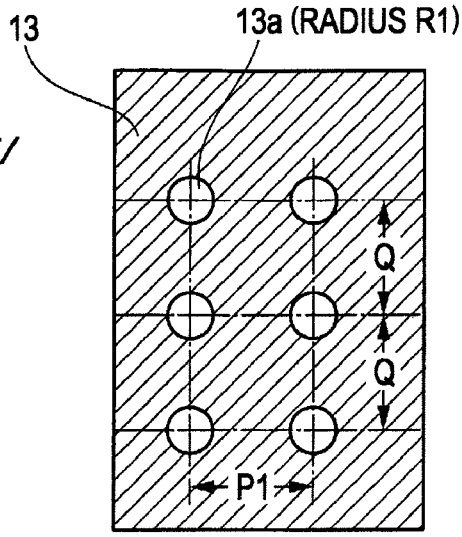
FIGS. 3A to 3C are plan views for illustrating the relationship between depressions in size and arrangement and the adhesive area rate A.
Figure 3B:
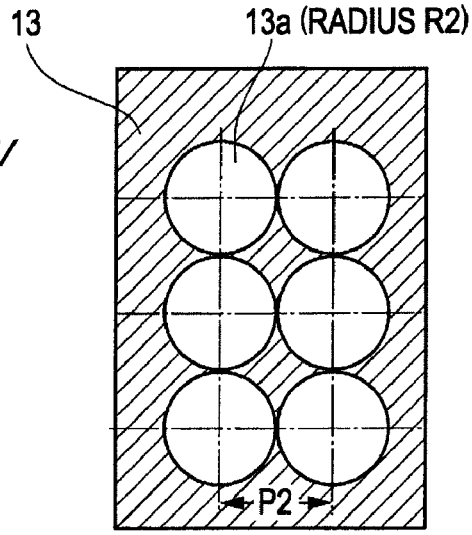
Figure 3C:
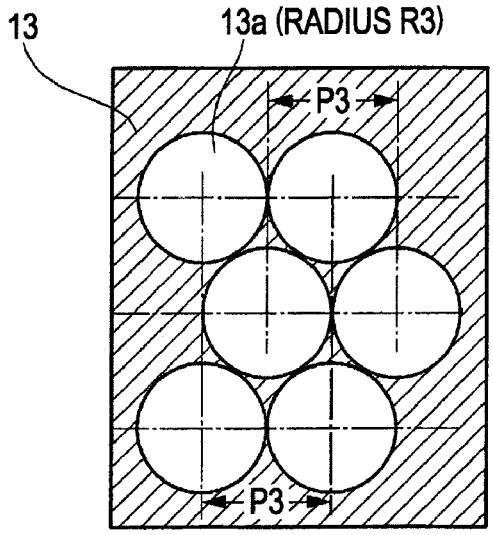

FIGS. 3A to 3C are plan views for illustrating the relationship between the size/arrangement of the depression 13*a* and the adhesive area rate.

As described above, in the head 10 according to the embodiment, by providing a plurality of the depressions 13*a* in the barrier layer 13, projections on the surface (adhesive region) of the barrier layer 13 are reduced so that entire portions other than the depressions 13*a* can be securely adhered.

However, if the depression 13*a* is excessively increased in size, the area associated with the adhesion in practice is largely decreased so that the preferable adhesive strength is difficult to be obtained. Then, the size of the depression 13*a* is determined by defining the adhesive area rate A=(A−a)/A, where A is the area of the adhesive region of the barrier layer 13 (area other than those of the ink chambers 15 and ink flow paths) and "a" is the total sum of circumscribed areas of the depressions 13*a*.

If ink is assumed to leak into one depression 13*a*, for preventing the ink from being continuously passed to other depressions 13*a*, as shown in FIG. 3A, the contours of the depressions 13*a* are to be in non-contact with each other and a barrier has to be provided between the depressions 13*a* adjacent to each other (orthogonal array/non-contact). Accordingly, the size of the depression 13*a* has a limit in that its contour comes in contact with another contour. FIG. 3B shows the limit of the orthogonal array (orthogonal array/contact); FIG. 3C shows the limit of the hexagonal lattice arrangement (hexagonal lattice arrangement/contact).

The adhesive area ratio ∧ is expressed by $\wedge=(A-a)/A=1-\pi R^2/(P\times Q)$. In the orthogonal array shown in FIG. 3B, P (=P2)=Q=2×(R (=R2)), so that ∧=21.5%. On the other hand, in the hexagonal lattice arrangement shown in FIG. 3C, P (=P3)=2×(R (=R3)), Q=(√3)×R3, so that ∧=9.3%. Hence, in order to allow the contours of the depressions 13*a* to be in non-contact with each other (the width of the barrier of the depression 13*a*>0 μm), despite of the arrangement, ∧ must be ∧ >21.5%. The minimum width of the barrier of the depression 13*a* needs to be about 10 μm in view of safety, so that ∧ >40% in practice.

In order to have the depression 13*a*, A must be A<100%. Also, for confirming the effect of the existence of the depression 13*a*, it is experimentally necessary that A<90%. Therefore, it is preferable that the adhesive area ratio ∧ be 90%> ∧ >40%. Then, examples in that the adhesive area ratio ∧ of the circular depression 13*a* is changed will be described.

Figure 4A:
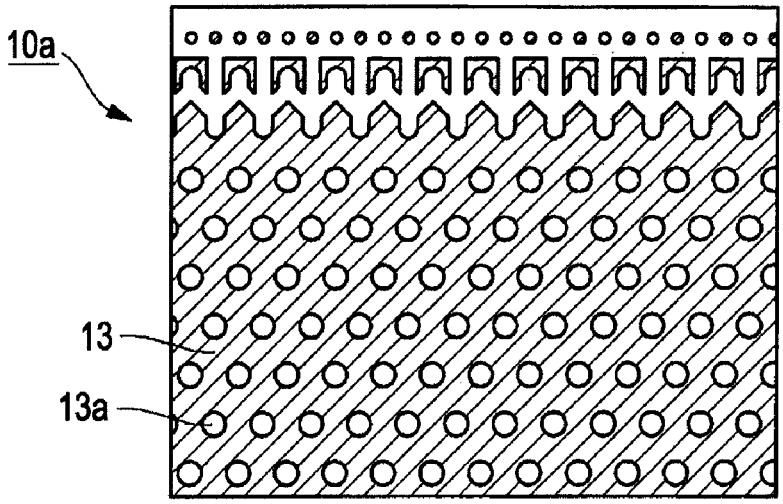
FIGS. 4A and 4B are partial plan views of the head according to the embodiment in which the adhesive area rate A is changed.
Figure 4B:
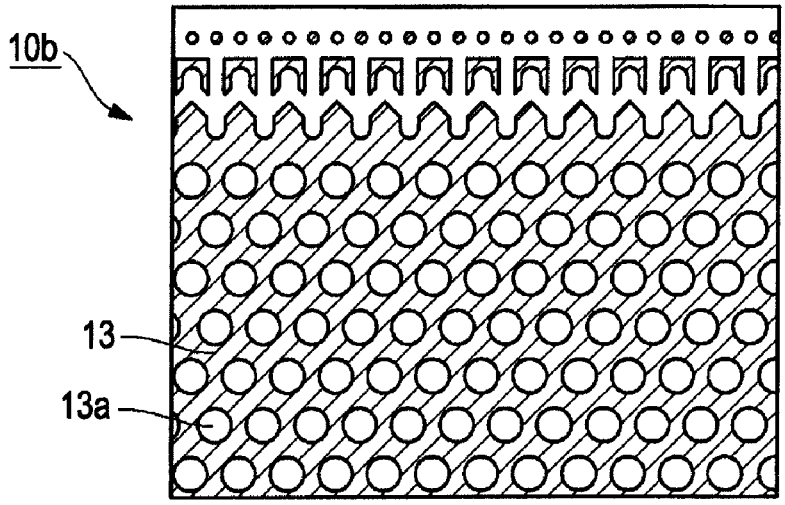

FIGS. 4A and 4B are partial plan views showing a head 10*a* of an example 1 and a head 10*b* of an example 2 in that the adhesive area ratio ∧ is changed. FIGS. 5A and 5B are tables showing specifications and manufacturing conditions of the head 10*a* of the example 1 and the head 10*b* of the example 2. A conventional example is also shown in FIGS. 5A and 5B for comparative sake.

As shown in FIGS. 4A and 4B, in the head 10*a* of the example 1 and the head 10*b* of the example 2, the circular depressions 13*a* are arranged in a honey-comb arrangement slightly longer than is wide (hexagonal lattice arrangement). The reason is that since the nozzles 16*a* (see FIG. 1) are arranged in a staggered array at intervals of 600 DPI (42.3 μm) in width and 300 DPI (84.6 μm) in length, the arrangement is agreed to this array. As shown in FIG. 5A, in the head 10*a* of the example 1, the adhesive area ratio ∧ is 82% (the hole diameter (=2R) of the depression 13*a* is 40 μm) and in the head 10*b* of the example 2, the adhesive area ratio ∧ is 60% (the hole diameter (=2R) of the depression 13*a* is 60 μm). The chip size in FIG. 5A is the size of the head chip 11 (see FIG. 1); the adhesive area is the area of the adhesive region other than the ink chambers 15 (see FIG. 1) and ink flow paths; and the minimum barrier width is the minimum value (P−2R) of the thickness of the barrier setting a space between the depressions 13*a*.

The reason why the adhesive area ratio ∧ is 82% and 60% is that the adhesive area ratio ∧ in the vicinity of the ink chamber 15 and the ink flow path is about 40% (about 42% in the head 10*a* and the head 10*b* shown in FIGS. 4A and 4B), so that the adhesive conditions are unified if the same value is applied over the entire area. However, a slightly higher value is established also by the following reason.

The depression 13*a* arranged on the barrier layer 13 is formed together with the ink chamber 15 and the ink flow path by the development processing after depositing a photosensitive cyclized-rubber resist on the semiconductor substrate 12. At this time, the ink chamber 15 and the ink flow path are communicated with each other so that the residual resist (non-removed resist) may not be produced while the depression 13*a* is independent, so that the residual resist may be produced. The limited hole diameter (=2R) in that the depression 13*a* can be safely formed without producing the residual resist is about 30 μm. Hence, in the head 10*a* of the example 1, the hole diameter (=2R) of the depression 13*a* is 40 μm with an allowance, and the space between the depressions 13*a* is 84.6 pin (equivalent to 300 DPI), so that the adhesive area ratio ∧ is set 82%. The minimum barrier width is 42.4 μm, in this case.

On the other hand, in view of the strength of the barrier layer 13 made of the photosensitive cyclized-rubber resist, a width of about 20 μm is required for the reliable barrier of the depression 13*a* regularly arranged in the hexagonal lattice arrangement. Hence, in the head 10*b* of the example 2, the minimum barrier width of the depression 13*a* is set at 22. 4 μm with an allowance, so that the adhesive area ratio ∧ becomes 60%.

The manufacturing conditions of the head 10*a* of the example 1 and the head 10*b* of the example 2 are shown in FIG. 5B. That is, in process (1), the nozzle sheet 16 is bonded to a frame (strength member) at predetermined temperature and pressure for a predetermined time. Sequentially, in process (2), the head chip 11 is bonded to the nozzle sheet 16, and in process (3), the barrier layer 13 is cured. In the conventional example, the example 1, and the example 2, the same material with the same size is used under the same conditions.

In such a manner, predetermined temperatures are applied in the processes (1) to (3); for the bonding of the barrier layer 13 with the depressions 13*a* to the nozzle sheet 16 in the process (2), a temperature sufficiently higher than the operating temperature of the head 10*a* (10*b*) is applied. That is, the operating temperature is about 65° C. (general maximum room temperature+temperature rise due to the interior heat gain 20° C.), while the temperature in the process (2) is 140±5° C. The reason is that the negative pressure generated in the depression 13*a* is utilized.

Figure 6:
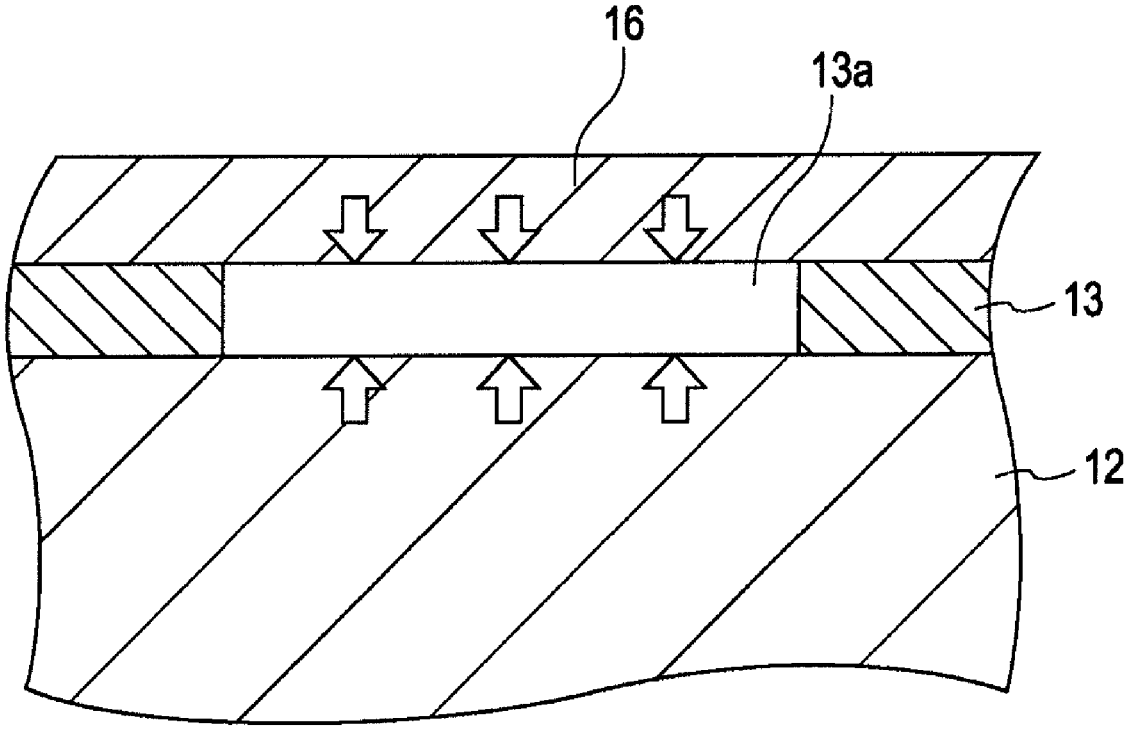
FIG. 6 is a sectional view for illustrating the action of the negative pressure generated in the depression.

FIG. 6 is a sectional view for illustrating the operation of the negative pressure generated in the depression 13*a*. In the process (2) for bonding the barrier layer 13 to the nozzle sheet 16, air is enclosed within the depression 13*a* at high temperature (Tm), and the air once enclosed is changed in pressure with changing temperature unless it leaks. If Tm>Tn in comparison with the operating temperature Tn of the head 10*a* (10*b*), the pressure in the depression 13*a* is reduced, so that the semiconductor substrate 12 and the nozzle sheet 16, which are in contact with the depression 13*a*, are attracted to each other due to the negative pressure as shown in arrows of FIG. 6. Then, the force due to the negative pressure is added to the adhesive force so as to increase the overall adhesive force. If the temperature starts decreasing from the stage in that the adhesion is not yet completed, the suction force due to the negative pressure is applied, so that the negative pressure effectively acts in the vicinity to the depression 13*a* in addition to the pressure (pressurizing) required for the bonding so as to unify the adhesive strength.

The head 10*a* of the example 1 and the head 10*b* of the example 2 manufactured according to such specifications and under such manufacturing conditions were checked by visual observation. As a result, the contour of the barrier layer 13 can be clearly confirmed as a shadow on the ejection surface (the upper surface in FIG. 1) of the nozzle sheet 16. Therefore, it is understood that the adhesion be finely achieved spreading all the corners.

Figure 7A:
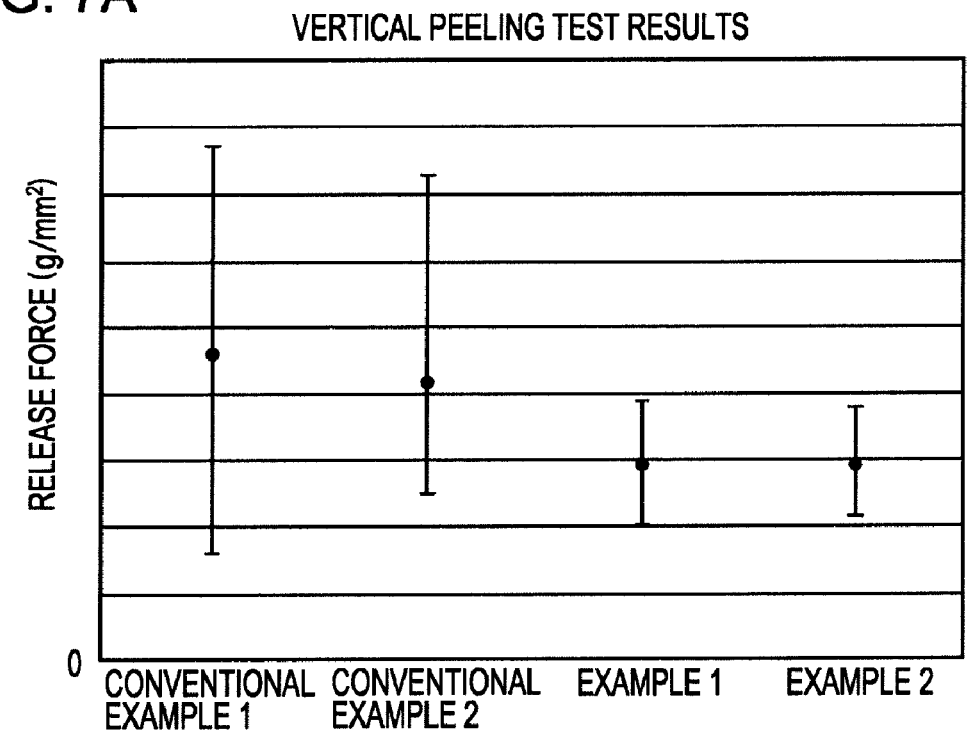
FIGS. 7A and 7B are graphs showing confirmation experimental results of the adhesive strength in the head according to the embodiment.
Figure 7B:
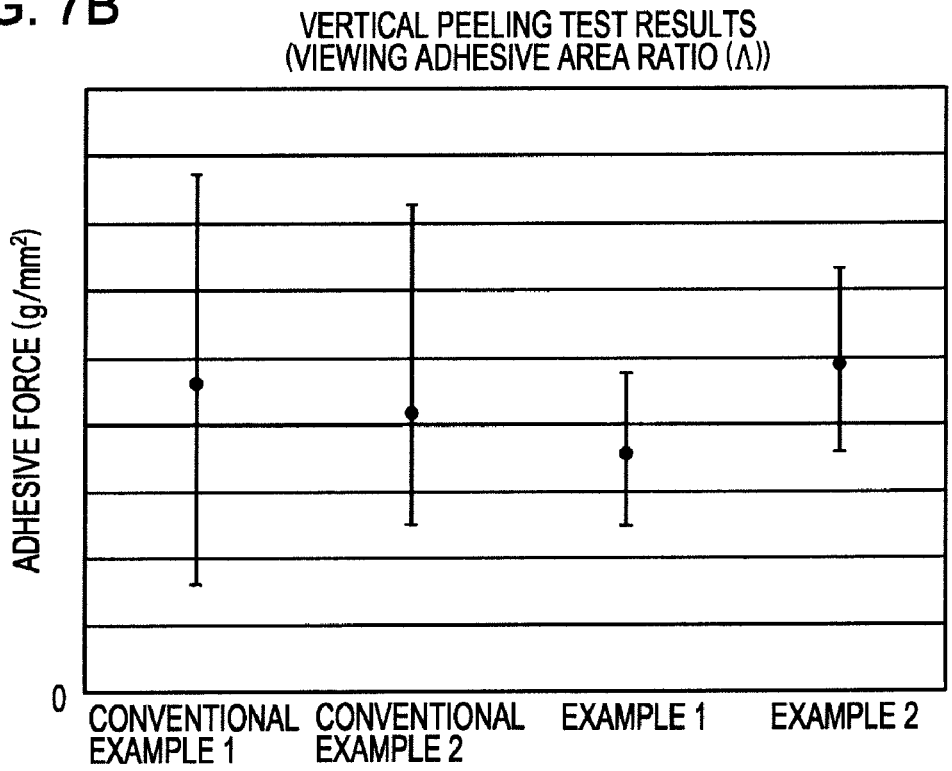

FIGS. 7A and 7B are graphs showing confirmed results of the adhesive strength experiments for the head 10*a* of the example 1 and the head 10*b* of the example 2, including the conventional example for comparative sake.

In the adhesive strength confirmation experiment, for testing at a four-color line type inkjet printer including the 64 head chips 11 (see FIG. 1), the conventional examples without the depression 13*a* (conventional examples 1 and 2), and the examples 1 and 2 shown in FIGS. 4A to 5B were manufactured. Eight head chips 11 were selected from the 64 head chips 11 at random for the adhesive strength confirmation experiment.

FIG. 7A is a graph showing results of the vertical peeling test of the nozzle sheet 16 from the head chip 11, in which the center point shows the average value of the obtained release forces and the length of the vertical line segment passing through the center point shows the dispersion range, both ends of the segment showing the maximum and minimum values of the dispersion, respectively. FIG. 7B is a graph when taking account of the adhesive area ratio ∧.

As shown in FIG. 7A, the dispersion of the release forces is very small so as to be almost uniform in the example 1 and the example 2 in comparison with those of the conventional examples 1 and 2. Also, the adhesive area ratio ∧ of the example 1 is 82% and that of the example 2 is 60%. In the average values of the release force, in comparison with those of the conventional examples 1 and 2 (the adhesive area ratio ∧ is 100%), the average values are not reduced as much as the reduction in adhesive area ratio.

As shown in FIG. 7B, when taking account of the difference of the adhesive area rtio ∧, the adhesive forces of the examples 1 and 2 are lager than those of the conventional examples 1 and 2. In particular, in the example 2, although the adhesive area ratio ∧ is the lowest, the adhesion is achieved most securely, demonstrating the effectiveness of the depression 13*a*.

In such a manner, the head 10 according to the embodiment (the head 10*a* of the example 1 and the head 10*b* of the example 2) is provided with a plurality of depressions 13*a*, each having an independent contour, arranged within a region separated from the border of the barrier layer 13, so that the unevenness effect of the surface (adhesive region) of the barrier layer 13 can be reduced. Simultaneously, during curing of the barrier layer 13 directly after the adhering, with decreasing ambient temperature, the pressure of residual air of the depression 13*a* decreases so as to generate the negative pressure. As a result, the nozzle sheet 16 is sucked so that the adhesion between the barrier layer 13 and the nozzle sheet 16 is increased, increasing the overall adhesive force.

The nozzle sheet 16 is also provided with a dummy chip (not shown) bonded thereon in addition to the head chip 11 (see FIG. 1) to form the head 10 (10*a*, 10*b*). Hence, it is preferable to provide the same depressions not only on the barrier layer 13 of the head chip 11 but also on the adhesive region between the dummy chip and the nozzle sheet 16.

The nozzle sheet 16 may also have through holes provided on at least part of the depressions 13*a*. By the through holes, although the negative pressure effect cannot be obtained, air contained within the depressions 13*a* escapes via the through holes when the pressure is applied during the bonding, so that much more pressure is applied, improving the adhesive strength. It is preferable that the through holes be arranged specifically on both sides of the ink chambers 15 and ink flow paths.

Figure 8A:
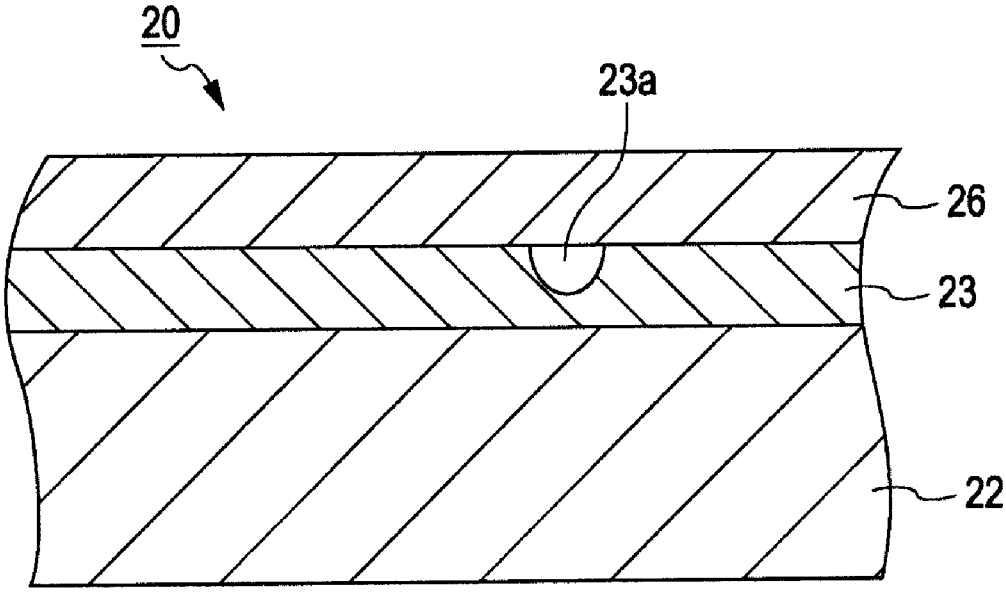
FIGS. 8A and 8B are sectional views of a head according to another embodiment.
Figure 8B:
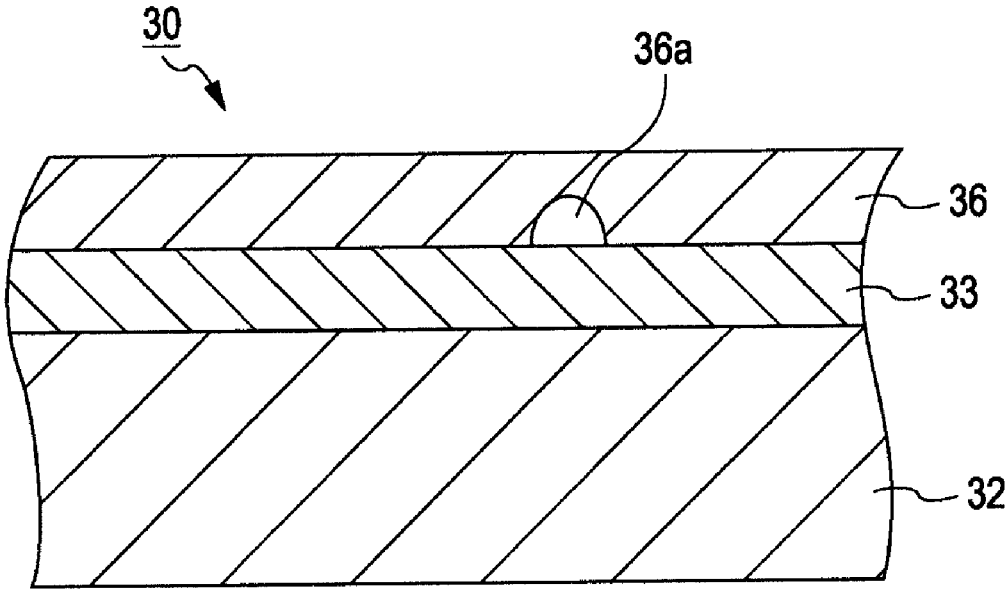
Figure 9:
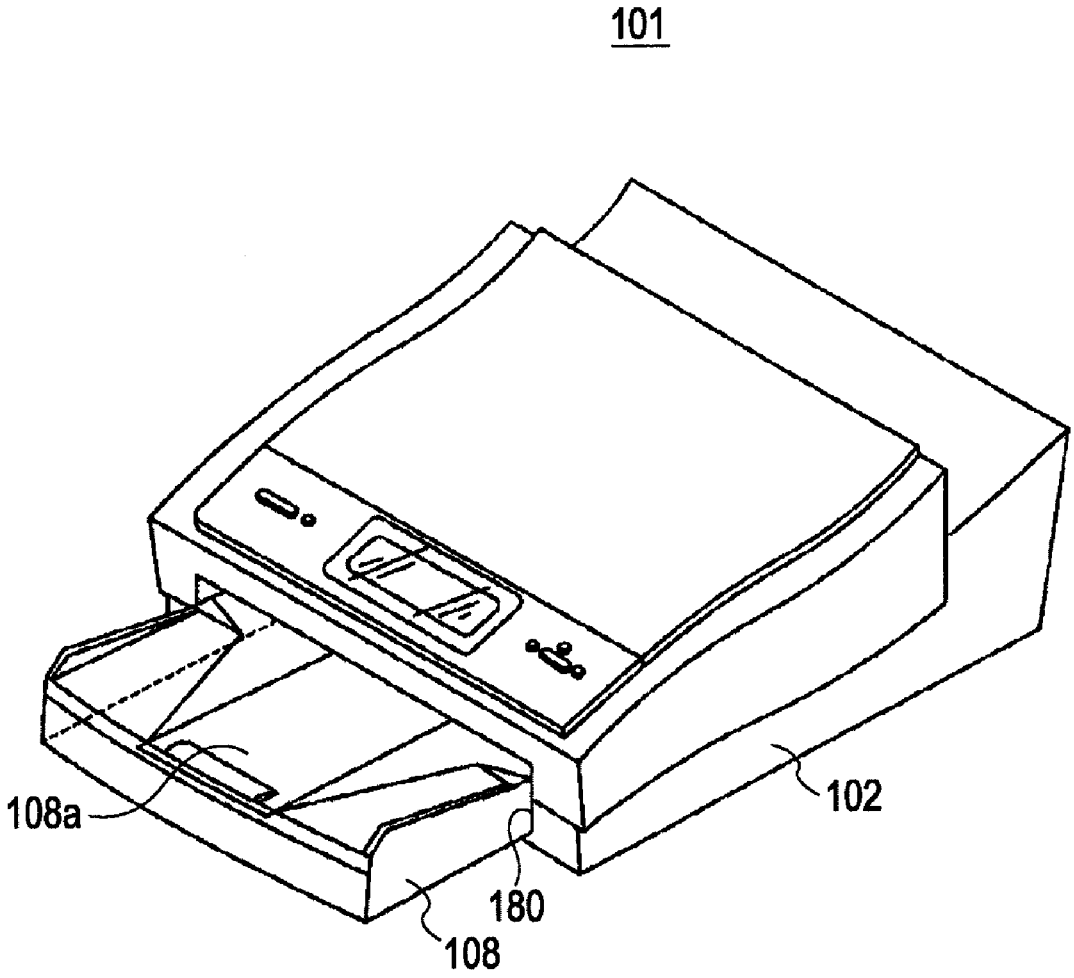
FIG. 9 is an exterior perspective view of an inkjet printer according to the embodiment of the present invention.
Figure 10:
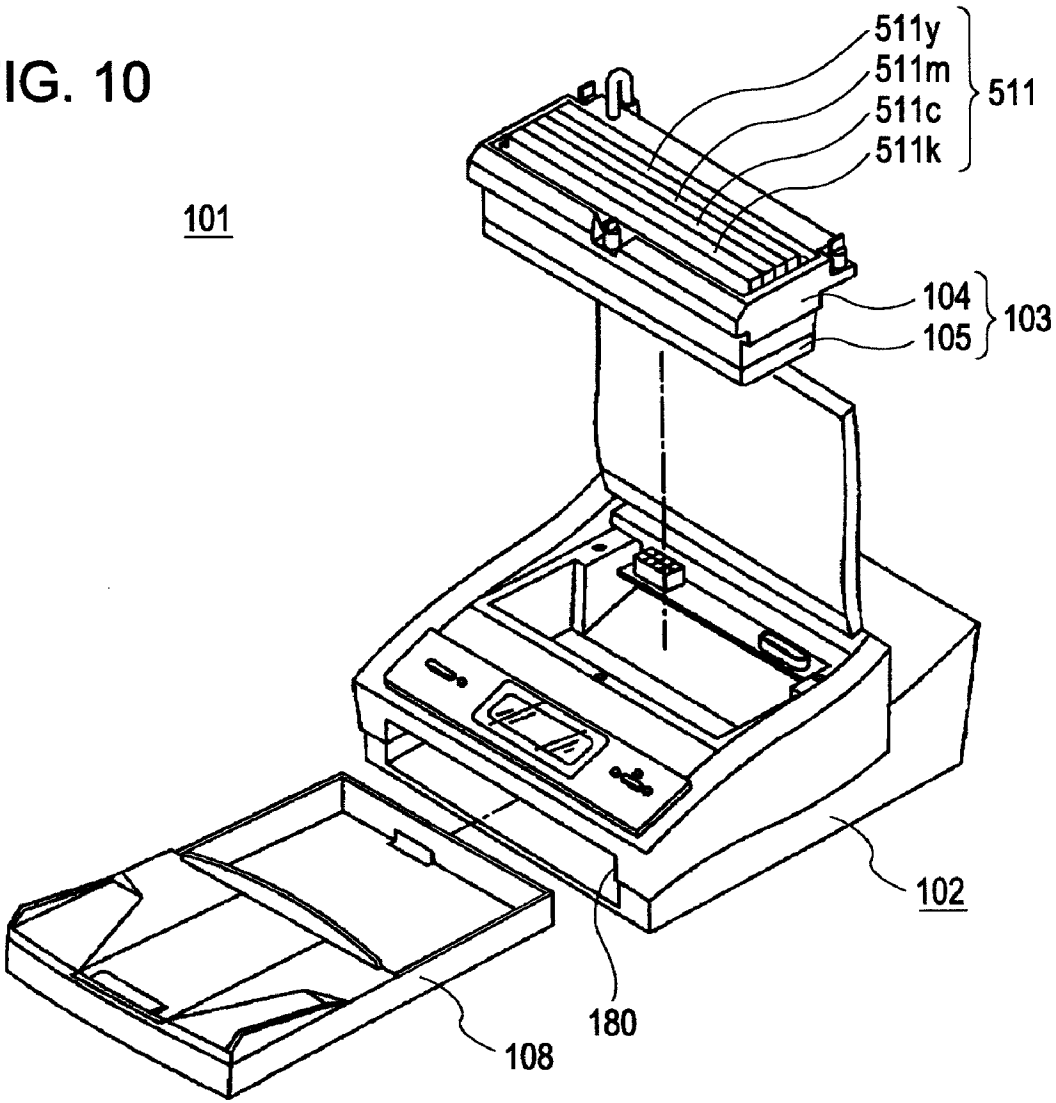
FIG. 10 is an exterior perspective view of a printer to be mounted by an inkjet head and a recording sheet tray.

FIGS. 8A and 8B are sectional views of a head 20 and a head 30 according to other embodiments, respectively. In the head 10 according to the embodiment and shown in FIG. 1, the depression 13*a* is a through-hole cutting through the barrier layer 13 from the bonding surface to the nozzle sheet 16 to the depositing surface on the semiconductor substrate 12, as shown in FIG. 6. Whereas, in the head 20 according to the embodiment and shown in FIG. 8A, a depression 23*a* is a recess. In the head 30 according to the embodiment and shown in FIG. 8B, a depression is not provided in a barrier layer 33, but a nozzle sheet 36 is provided with a plurality of depressions 36*a* (recesses), each having an independent contour. The depressions 36*a* of the nozzle sheet 36 are arranged within a range separated from the border of the barrier layer 33.

In the head 20 according to the embodiment and shown in FIG. 8A, in the same way as in the head 10 according to the embodiment and shown in FIG. 6, the effect of unevenness of the surface (adhesive region) of the barrier layer 23 can be reduced, the adhesive strength of the nozzle sheet 26 is uniformly increased. Also, during curing of the barrier layer 23, the negative pressure is generated within the depression 23*a*, so that the nozzle sheet 26 is sucked, the adhesion between the barrier layer 23 and the nozzle sheet 26 is increased, increasing the overall adhesive strength.

Furthermore, in the head 30 according to the embodiment and shown in FIG. 8B, convex portions on the surface (adhesive region) of the barrier layer 33 are absorbed by the depressions 36*a* of the nozzle sheet 36, so that the adhesion between the barrier layer 33 and the nozzle sheet 36 is increased, uniformly increasing the adhesive strength. Also, during curing of the barrier layer 33, the negative pressure is generated within the depression 33*a*, so that the barrier layer 33 is sucked, and the overall adhesive strength between the barrier layer 33 and the nozzle sheet 36 is increased.

The embodiments of the present invention have been described as above; however, the invention is not limited to the embodiments described above, so that various modifications can be made as follows:

(1) In the embodiments, the heads 10 (10*a*, 10*b*), 20, and 30 for use in an inkjet printer are exemplified; however, the liquid ejection head is not limited to these, so that not only ink but also various kinds of liquid can be applied to the liquid ejection head.

(2) According to the embodiments described above, a line-type inkjet printer is exemplified, in which a large number of the head chips 11 are arranged in the width direction of a photographic sheet so as to have a line-head share of a photographic width; alternatively, a serial-type inkjet printer may also be applied, in which a head is moved in the width direction of a photographic sheet so as to print images.

(3) According to the embodiments described above, a thermal type inkjet printer is exemplified, in which the heating element 14 is used as an energy-generating element; alternatively, an electrostatic ejection may be applied, in which liquid is ejected using an electrostatic force and an elastic force of a diaphragm. Also, a piezoelectric ejection may be applied, in which liquid droplets are ejected by deflecting a diaphragm with a piezoelectric effect.

(4) According to the embodiments described above, the ink chamber 15 and the ink flow path are formed on an end face of the head chip 11; however, the invention is not limited to this arrangement, so that the ink chamber 15 and the ink flow path may also be formed at the center of the head chip 11.

Next, a cleaning device of an inkjet printer for achieving another object mentioned above will be described with reference to the drawings. As shown in FIGS. 9 to 12, the cleaning device of the liquid ejection head is for use in the liquid ejection head of an inkjet printer 101 for printing images and characters by ejecting ink on a recording sheet. The inkjet printer 101 is a line head type having ink ejection nozzles with a width equivalent to the printing width of the recording sheet. The liquid ejection head used in the inkjet printer 101 may also adopt a conventional liquid ejection head in addition the head 10 according to the embodiment. That is, by the cleaning device according to the embodiment, ink and contaminants stuck to the liquid ejection head of the inkjet printer 101 using the conventional liquid ejection head can be certainly removed so as to secure stable liquid ejection performances. Then, by using the cleaning device according to the embodiment together with the head 10 according to the embodiment of the present invention, the above-effect is further increased, sufficiently ensuring the liquid ejection performances and the product life.

The inkjet printer 101 includes a printer body 102, and the printer body 102 includes a liquid ejection head 104 having an ink cartridge mounted thereon for ejecting ink, an inkjet head 103 having a head cap 105 for protecting the liquid ejection head 104, a cap movement mechanism 106 for moving the liquid ejection head 104 in open/close directions, a control unit 107 for controlling the inkjet printer 101, and a recording sheet tray 108 for accommodating recording sheets.

In the inkjet printer 101, the inkjet head 103 is detachable with the printer body 102, and further, ink cartridges 511*y*, 511*m*, 511*c*, and 511*k*, which are ink supply sources, are detachable with the liquid ejection head 104. In the inkjet printer 101, the yellow inkjet cartridge 511*y*, the magenta inkjet cartridge 511*m*, the cyan inkjet cartridge 511*c*, and the black inkjet cartridge 511*k* are used. Also, the inkjet cartridges 511*y*, 511*m*, 511*c*, and 511*k* are replaceable as consumables with the inkjet head 103 and the liquid ejection head 104 detachable with the printer body 102.

In the inkjet printer 101, by mounting the recording sheet tray 108 in a tray mount opening 180 provided in the front bottom of the printer body 102, recording sheets P accommodated in the recording sheet tray 108 can be fed into the printer body 102. When the recording sheet tray 108 is mounted in the tray mount opening 180, by a sheet feed/discharge mechanism 109 provided in the apparatus, the recording sheet p is pressed into contact with a feed roller 181, and by rotating the feed roller 181, the recording sheet p is fed from the tray mount opening 180 toward the back face of the printer body 102 in arrow A direction in FIG. 12.

Then, in the inkjet printer 101, the recording sheet p fed to the back face of the printer body 102 is inverted by an inversion roller 183, and then it is fed from the back face toward the front face of the printer body 102. On the recording sheet p being fed toward the front face from the back face of the printer body 102, characters or images are printed by the liquid ejection head 104 before the recording sheet p is discharged from the tray mount opening 180, the characters or images being corresponding to character data or image data inputted from an information processing device such as a personal computer.

Figure 11:
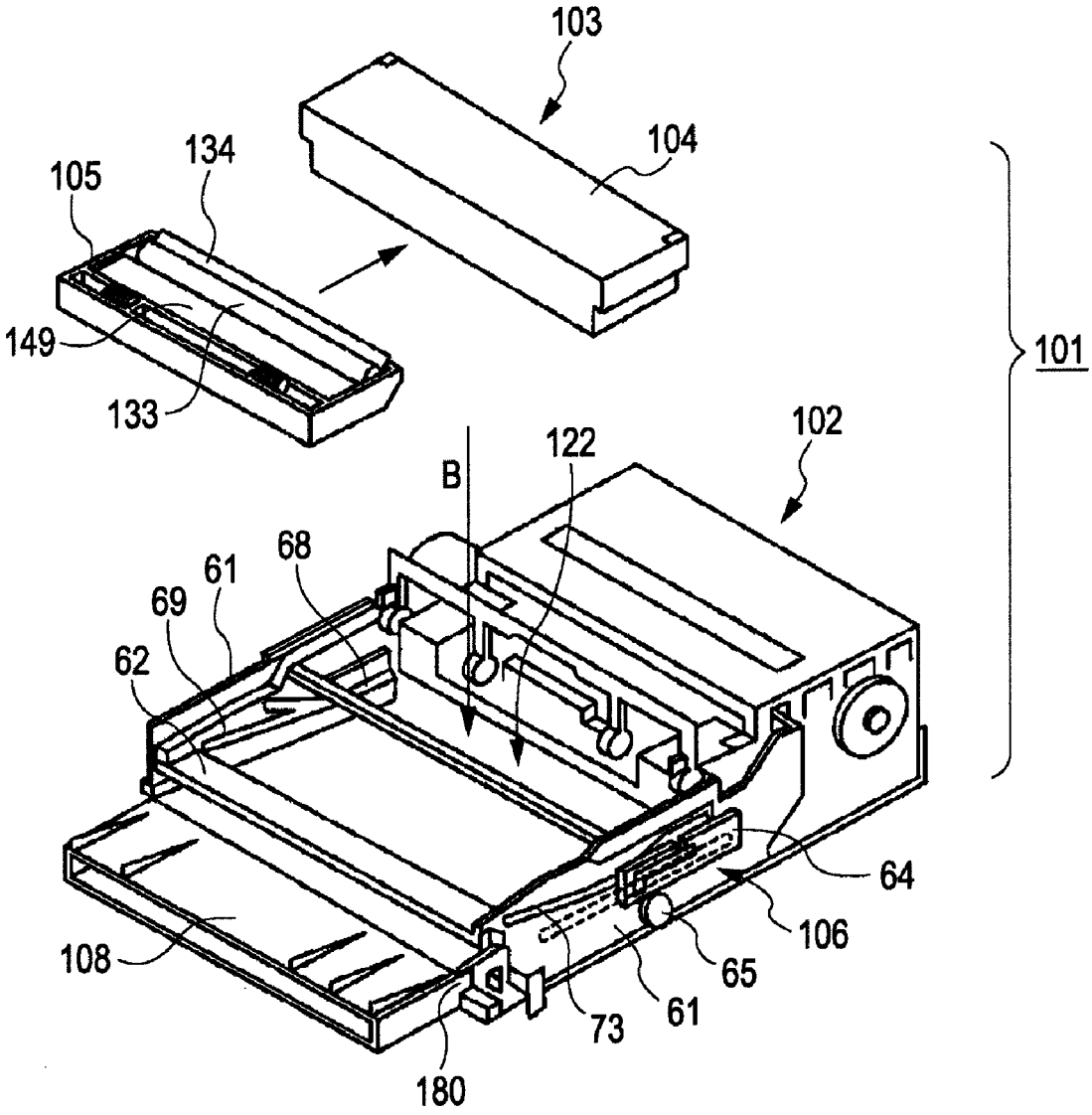
FIG. 11 is an exploded perspective view of the inkjet printer.

The liquid ejection head 104 for printing images on the recording sheet p is mounted on a cartridge mounting part 522 from the top of the printer body 102, as shown in arrow B of FIG. 11, so as to eject ink on the recording sheet p running through the way back for printing. Specifically, the liquid ejection head 104 ejects ink i by forming it into fine particles by the electro-thermal conversion or electro-mechanical conversion so as to spray them onto the recording sheet p for printing.

Figure 13:
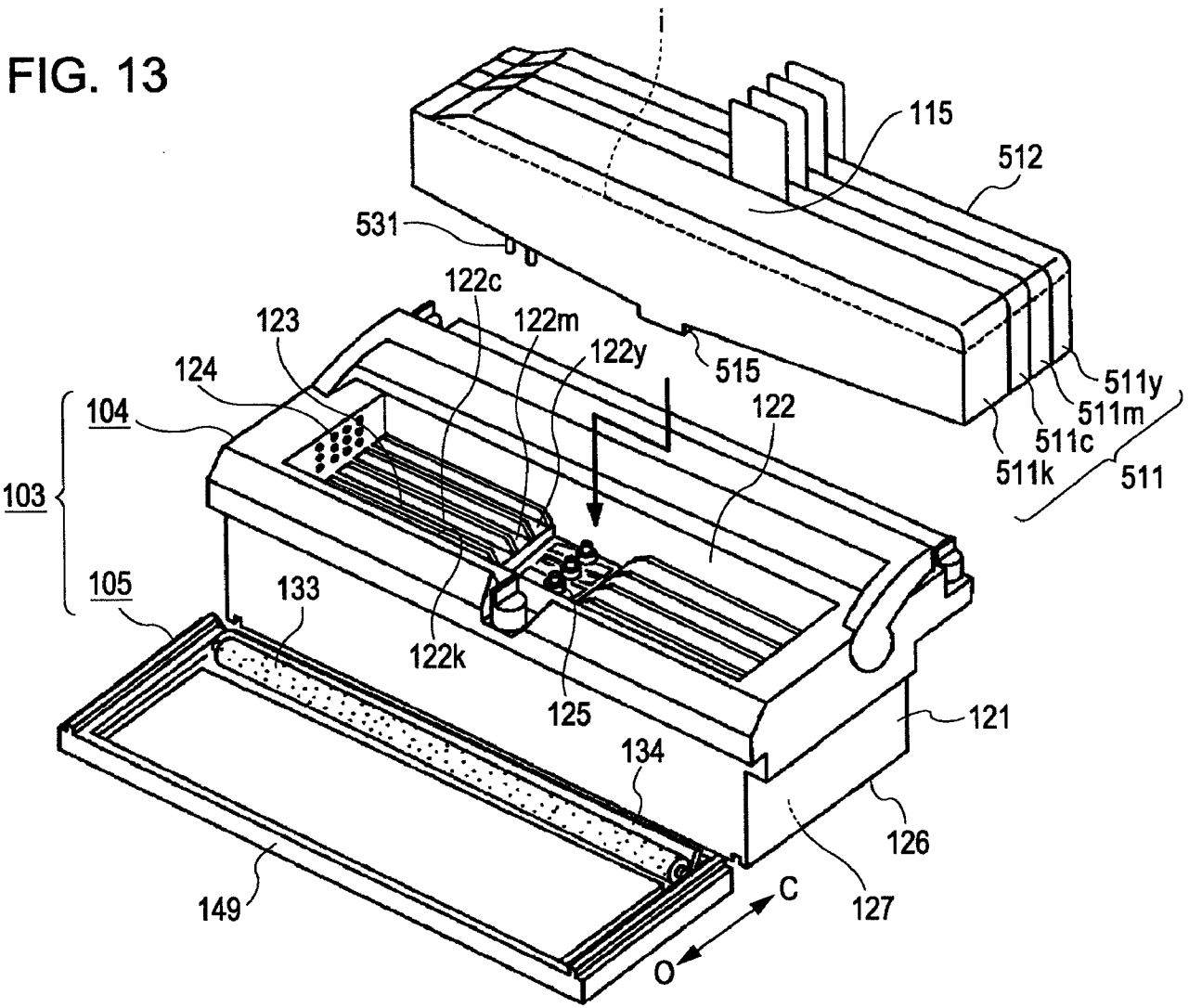
FIG. 13 is a perspective view of the inkjet printer.
Figure 14:
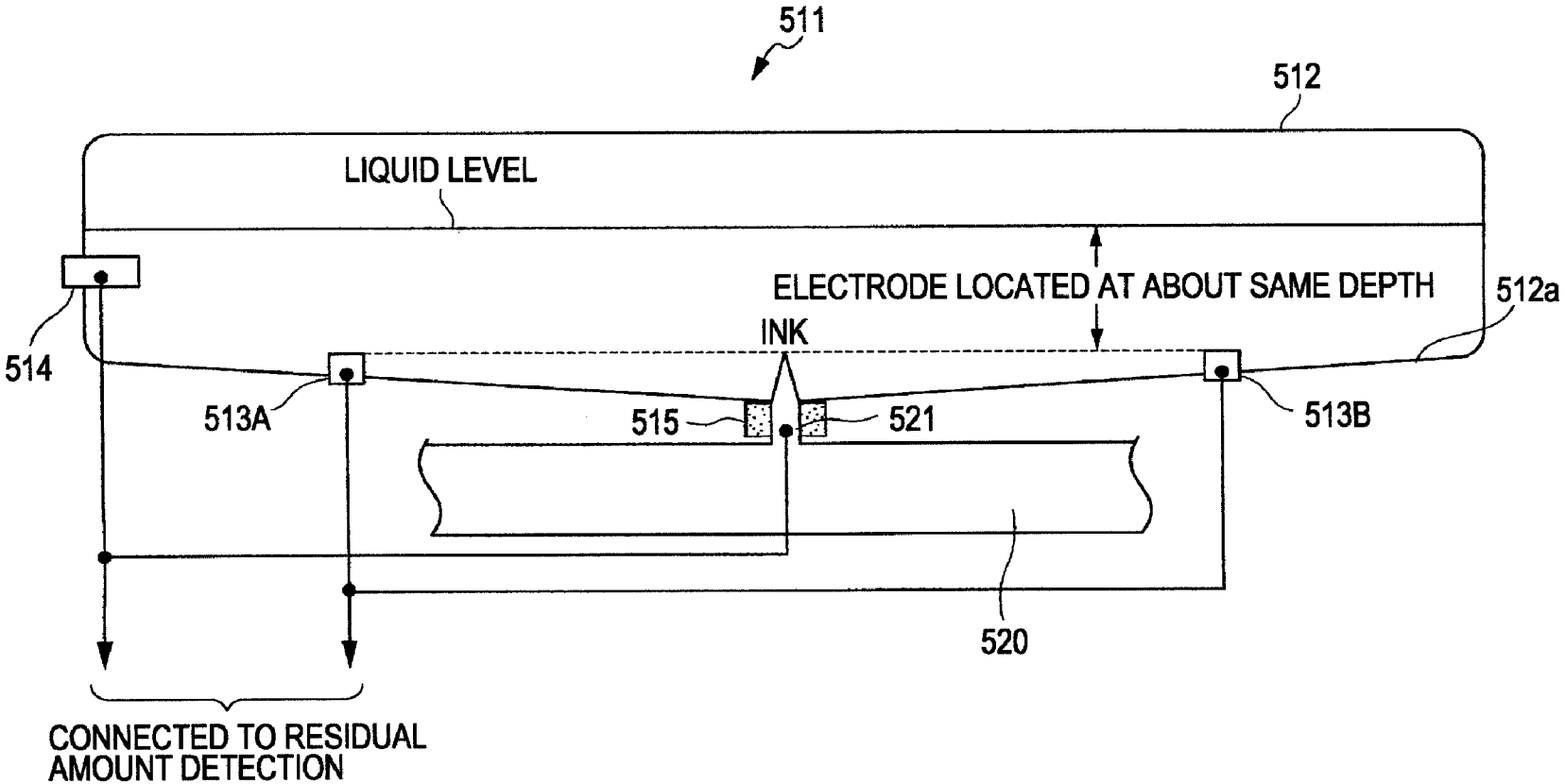
FIG. 14 is a sectional view of an ink cartridge according to the embodiment viewed from the front.
Figure 15:
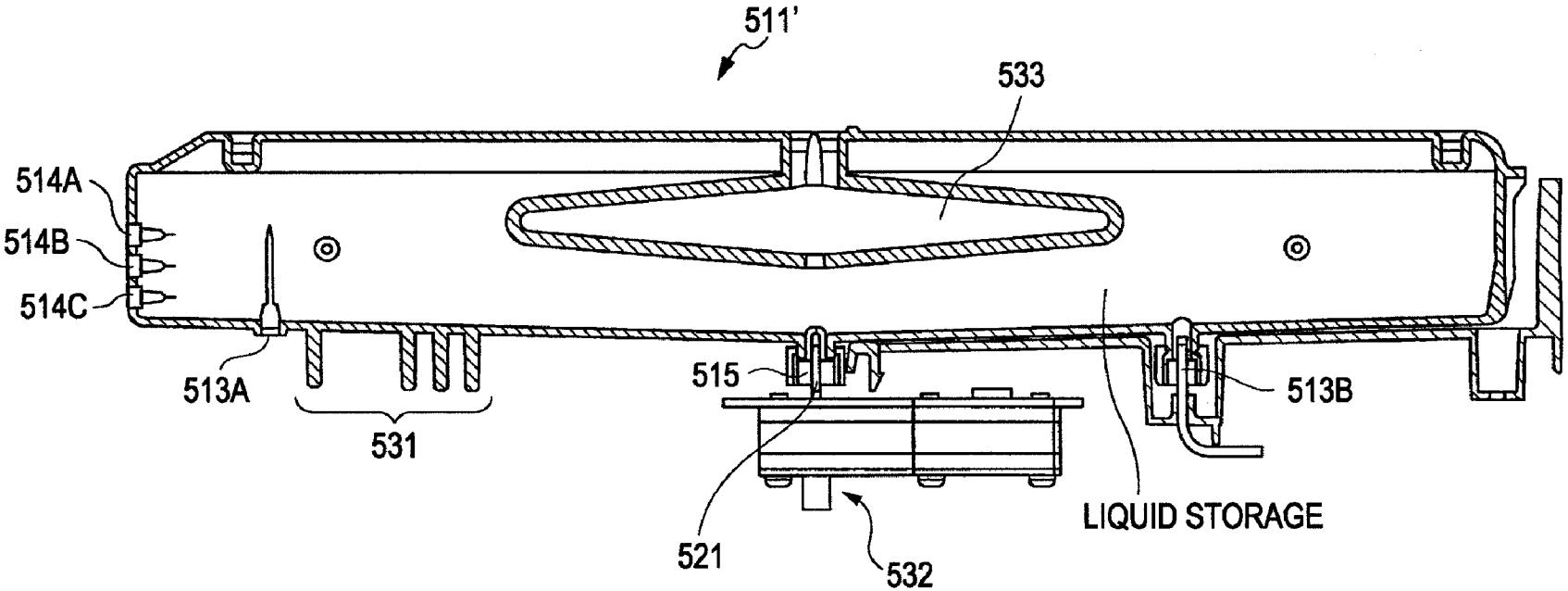
FIG. 15 is a drawing of the manufactured ink cartridge according to the embodiment.

The ink cartridge 511 for supplying ink to the liquid ejection head 104, as shown in FIGS. 13 and 14, has a cartridge tank 512, which is substantially shaped in a rectangle with substantially the same width as that of the recording sheet p used in a longitudinal direction so as to increase the ink capacity as much as possible. FIG. 15 is a sectional view of the ink cartridge 511 viewed from the front. A line head 520 is communicated with an ink supply port 515 of the ink cartridge 511 for ejecting ink fed from the ink supply port 515. In FIG. 14, parts of the line head 520 until both ends in the longitudinal direction are omitted.

The cartridge tank 512 is provided with the hollow cylindrical ink supply port 515 provided at the deepest part of the bottom surface 512*a* inside the cartridge tank 512. The bottom surface 512*a* is inclined so that when viewed along a surface perpendicular to the liquid level and passing through the center of the ink supply port 515, the closer to the ink supply port 515, the depth from the liquid level is increased. Accordingly, even when the cartridge tank 512 or the printer body 102 is inclined about the ink supply port 515 clockwise or counterclockwise so that the horizontal line of ink is inclined by an angle corresponding to the inclination of the bottom surface 512*a*, the ink contained in the cartridge tank 512 can flow toward the ink supply port 515.

Furthermore, inside on the bottom surface 512*a*, two second electrodes 513A and 513B are arranged for detecting the presence of ink in the cartridge tank 512. The second electrodes 513A and 513B are located at two positions, respectively, with the ink supply port 515 therebetween and having the same depth on the bottom surface 512*a*.

Moreover, one third electrode 514 is arranged inside on a side face of the cartridge tank 512 for detecting the presence of ink in the cartridge tank 512 in the same way as in the second electrodes 513A and 513B. In particular, this is for detecting the presence of ink in the cartridge tank 512 directly after the ink cartridge 511 is mounted (this will be described later). Also, the shape of the outside surface of the cartridge tank 512 is not noticed as long as electrically conductive surfaces of the second electrodes 513A and 513B@ and the third electrode 514 are exposed inside the cartridge tank 512.

The ink cartridge 511 is connected to the printer body by inserting a hollow needle 521 (made of a conductive material such as stainless) provided in the printer body 102 into the ink supply port 515. The presence of ink is detected first by the second electrodes 513A and 513B. Since the second electrodes 513A and 513B are electrically connected together, if at least one of them comes in contact with ink in the cartridge tank 512, the second electrodes 513A and 513B are electrically connected to the ink so as to detect the presence of ink. In other words, the presence of ink is determined until both the second electrodes 513A and 513B are brought out of contact with the ink. By such a configuration, although depending on the positions of the second electrodes 513A and 513B to some extent, the presence of ink can be detected until ink is almost eliminated. That is, ink can be almost made full use.

According to the embodiment, the hollow needle 521 arranged in the printer body is used as an electrode (also referred to as a first electrode 521 below). The first electrode 521 is arranged at a position downstream the second electrodes 513A and 513B, and is communicated with the ink supply port 515 in the outside of the cartridge tank 512 so as to electrically connect thereto as long as ink continuously flows from the ink supply port 515. Thus, by the change in electric conductivity between the first electrode 521 and the second electrodes 513A and 513B, the presence of ink in the cartridge tank 512 can be detected.

However, when ink contained in the cartridge tank 512 has run out, the replenishing of ink may be hindered. While ink is continuously fed without entrained air, the ink continuity is ensured even outside the cartridge tank 512, so that any part close to the cartridge tank 512 along the flow (the first electrode 521 according to the embodiment) can confirm the presence of ink by measuring the change in electric conductivity to the inside of the cartridge tank 512.

By such a method, when the apparatus is once started and ink is normally supplied, the apparatus smoothly operates. Then, ink is also used up practically, exhibiting preferable detection characteristics. When ink is replenished in the empty cartridge tank 512, ink may be remained also in the ink supply port 515, so that after replenishment of ink, the operation is normally started again without problems.

However, when the ink cartridge 511 ink is replaced with that having ink without reusing the empty cartridge tank 512, a problem may arise. The reason is that the vicinity of the ink supply port 515 is in an unused state and is not wet with ink entirely, so that air may intermix. Thereby, the electric conductivity may be temporarily cut off. This problem is specific when the ink cartridge 511 is replaced with that having new ink, and after the initial stage, the normal operation is returned. In order to prevent this problem, according to the embodiment, the third electrode 514 is provided. The third electrode 514 is electrically connected to the first electrode 521.

First when ink is contained in the cartridge tank 512 and the apparatus operates normally, the first electrode 521 is in contact with ink so as to ensure the electric conduction, so that when the electric conduction to the second electrodes 513A and 513B is secured, the operation is continued as ink is present. When ink is run out and the electric conduction between the first electrode 521 and the second electrodes 513A and 513B is cut off, the absence of ink in the cartridge tank 512 is detected so as to stop operation. Then, even when an instruction to restart operation is issued by mistake, the presence of ink is not confirmed, so that the apparatus does not operate and a display that "ink replenishing is required" is outputted from the apparatus.

When the ink cartridges 511 is replaced with that having sufficient new ink, and even if air bubbles exist in the ink supply port 515 so as to cut off the electric conduction of the first electrode 521 to the second electrodes 513A and 513B, the third electrode 514 comes in contact with ink so as to electrically connect to the first electrode 521, so that the replenishing ink is confirmed so as to start operation. When the apparatus is once started, air babbles having existed in the vicinity of the ink supply port 515 are brought into the apparatus, so that electric conduction between the first electrode 521 and the second electrodes 513A and 513B is ensured so as to detect the presence of ink.

In such a manner described above, ink can be used to the minimum level which needs the replacing of the ink cartridge 511 or the replenishing ink. Hence, ink can be effectively and economically used so as to alleviate the recycling load. Furthermore, the error of ink detection due to aeration during replacing the ink cartridge 511 is eliminated.

FIG. 15 is a drawing of the ink cartridge 511' manufactured for the inkjet printer 101. The ink cartridge 511 shown in FIG. 15 is provided with ink-kind discriminating pins 531, an ink-pressure adjusting valve 532, and a vapor/liquid exchange unit 533. The vapor/liquid exchange unit 533 is equivalent to a buffer unit disclosed in Japanese Unexamined Patent Application Publication No. 2003-326737.

In the ink cartridge 511', on a side face and the bottom surface inside the ink cartridge 511, a plurality of the electrodes (the second electrodes 513A and 513B and third electrodes 514A to 514C) for the simplicity sake in arranging the electrodes. The change in electric conduction (specifically impedance Z) between the second electrode 513A as a common electrode and the third electrodes 514A to 514C, which are located at higher levels than that of the common electrode, is detected.

While ink is in contact with all these electrodes, the impedance value Z is low so as to determine the presence of ink. As ink is consumed, the third electrodes 514A to 514C sequentially come out of contact with ink in that order. At that times, the impedance Z between the common electrode (the second electrode 513A) and this electrode is sequentially increased, the absence of ink at this electrode is determined.

Furthermore, in the ink cartridge 511', in addition to these electrodes, the hollow needle 521 is used as the first electrode 521 for being inserted into the ink supply port 515 from the apparatus. By this method, when the impedance Z is increased between the second electrode 513A and the third electrode 514C (located at the lowest level among the third electrodes 514), the absence of ink has been detected so as to instruct the replacement of the ink cartridge 511, leaving the ink remained below the third electrode 514C unused. However, by providing the first electrode 521 in addition thereto as mentioned above, the ink can be used until the lower end of the second electrodes 513, extremely reducing the residual ink. The practical measured results include that the maximum capacity of the cartridge tank 512 used in the inkjet printer 101 is 52 ml and the residual ink can be reduced to almost less than 1 ml according to the embodiment, although about 10 ml has been remained by a conventional structure.

In addition, the ink cartridge 511 is not limited to the embodiment described above, so that various modifications can be made as follows:

(1) Since FIG. 14 is a sectional view along the surface perpendicular to the liquid level and passing through the center of the ink supply port 515, as long as the bottom surface along other surfaces is not lower than that of FIG. 14, the ink cartridge 511 viewed from the top of the cartridge tank 512 may be any shape such as a square, a rectangle, and a circle.

(2) FIG. 14 shows an example of the two second electrodes 513A and 513B; alternatively, when the ink cartridge 511 is vertically cylindrical, the second electrodes embedded at the same depth and connected together may be arranged about the ink supply port 515 at three positions spaced at intervals of 120° or at four positions spaced at intervals of 90°.

(3) According to the embodiment of the ink cartridge 511 described above, the hollow needle 521 is used as the first electrode 521; alternatively, the first electrode 521 may be used all for oneself as an electrode, or another member for another application may also serve as the first electrode 521.

In the ink cartridge 511, during normal printing, black ink is generally consumed mostly, so that the capacity of the ink cartridge 511*k* is the maximum in compassion with the other ink cartridges 511*y*, 511*m*, and 511*c*. Specifically, the ink cartridge 511*k* is formed in a thickness larger than those of the other ink cartridges 511*y*, 511*m*, and 511*c*.

Next, the configuration of the liquid ejection head 104 to be mounted by the ink cartridge 511 thereon will be described. The liquid ejection head 104, as shown in FIG. 13, includes a cartridge body 121 to be mounted by the ink cartridge 511 thereon. The cartridge body 121 includes an ink-kind discriminating pin recess 531*b* to be brought into engagement with a cartridge applied part 122 and the ink-kind discriminating pins 531; a residual ink detector 124 for detecting the residual ink in the ink cartridge 511; a connector 125 for connecting the ink supply port 515 thereto and to be supplied by ink i; and ink ejection nozzles 126 for ejecting ink, in which the bottom surface of the cartridge body 121 facing the ink ejection nozzles 126 is designated as an ink ejection surface 127.

In the cartridge applied part 122 to be mounted by the ink cartridge 511, the upper surface has an approximately concave shape to be respectively detachable with the ink cartridge 511. The cartridge applied parts 122*y*, 122*m*, 122*c*, and 122*k* to be detachable with the ink cartridges 511*y*, 511*m*, 511*c*, and 511*k* herein are accommodated in a line in a traveling direction of a recording sheet.

Engagement recesses 123 are provided in the cartridge applied parts 122*y*, 122*m*, 122*c*, and 122*k* so as to bring engagement with the ink-kind discriminating pins 531 arranged with patterns different every the ink cartridges 511*y*, 511*m*, 511*c*, and 511*k*, respectively.

The residual ink detector 124 is for stepwisely detecting the residual ink i in the ink cartridge 511 as mentioned above, and the residual ink detectors 124 are provided in the cartridge applied parts 122*y*, 122*m*, 122*c*, and 122*k* of the ink cartridges 511*y*, 511*m*, 511*c*, and 511*k*, respectively. When the ink cartridge 511 is mounted on the liquid ejection head 104, the residual ink detector 124 is brought into electrical contact with the third electrodes 514A to 514C arranged in line in the height direction of the ink cartridge 511 on a side face thereof.

At the approximate center of the cartridge applied part 122 in the longitudinal direction, the connector 125 is provided for connecting the ink supply port 515 thereto when the ink cartridge 511 is mounted on the cartridge applied part 122. The connector 125 forms an ink supply path, through which ink is supplied from the ink supply port 515 of the ink cartridge 511 to the ink ejection nozzles 126 provided on the bottom surface of the cartridge body 121. The connector 125 includes a valve mechanism, of which details are omitted, for adjusting the ink supplying from the cartridge tank 512 to the ink ejection nozzles 126.

Figure 16:
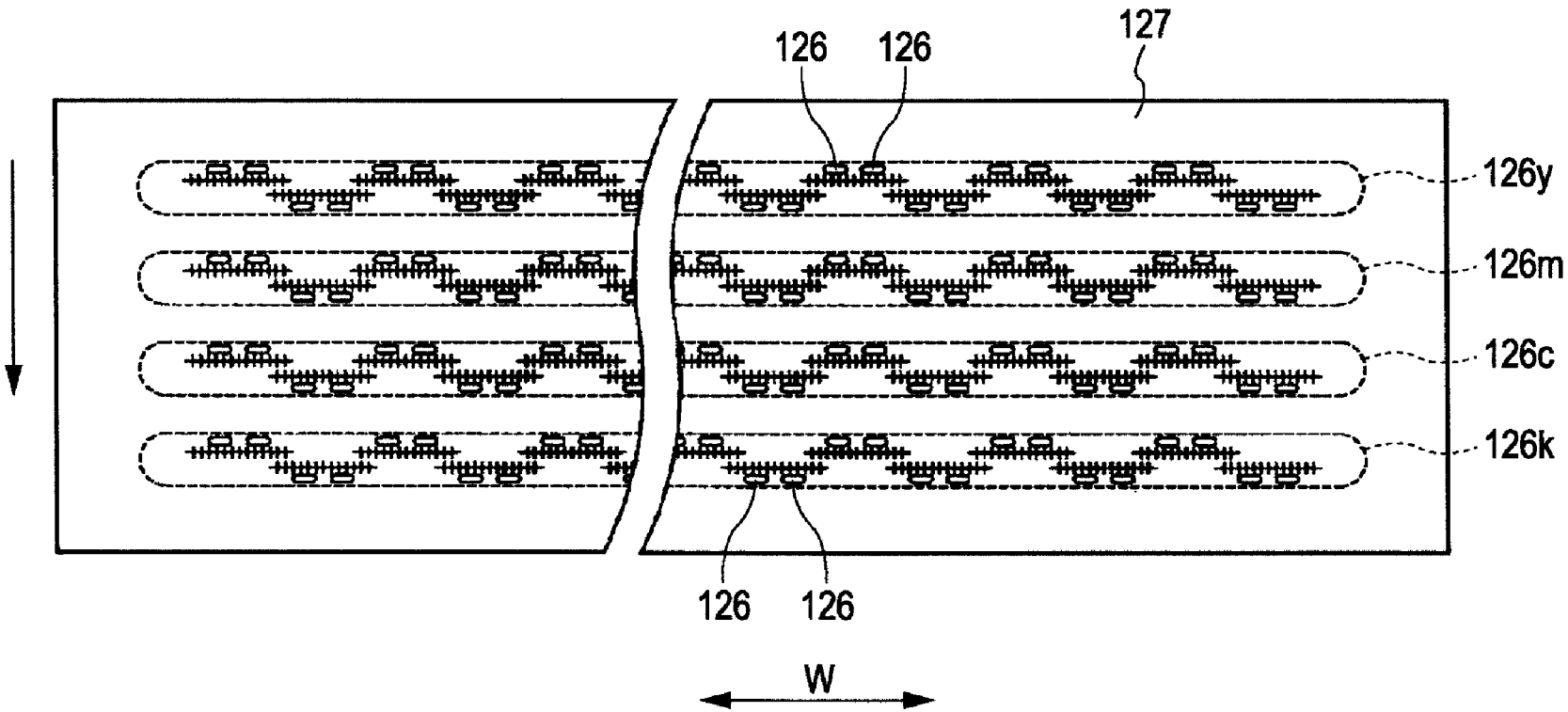
FIG. 16 is a plan view of an ink ejection surface of a head cartridge.

The ink ejection nozzles 126 are arranged on the ink ejection surface 127, which is the bottom surface of the cartridge body 121, along the longitudinal direction. That is, as shown in FIG. 16, the ink ejection nozzles 126 is arranged on the ink ejection surface 127 approximately in line for each color in arrow W direction of FIG. 16, which is the width direction of the recording sheet p. The ink ejection nozzles 126 are provided with nozzle lines 126*y*, 126*m*, 126*c*, and 126*k* arranged according to the arrangement of the ink cartridge 511 for each color mounted on the cartridge body 121 from the back of the printer body 102 toward the front. These nozzle lines 126*y*, 126*m*, 126*c*, and 126*k* have substantially the same width as that of the recording sheet p, and when printing on the recording sheet p, ink i is ejected for every nozzle lines 126*y*, 126*m*, 126*c*, and 126*k* without moving in the width direction of the recording sheet p.

Figure 17A:
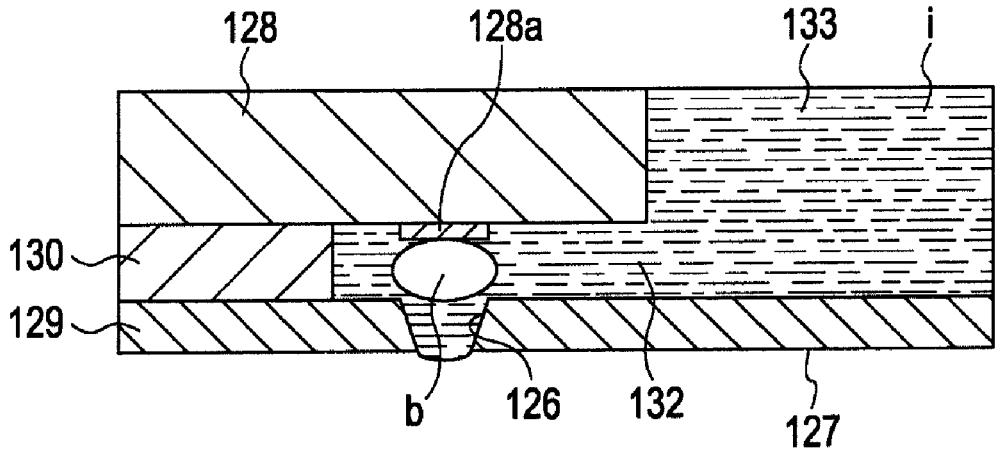
FIGS. 17A and 17B are sectional views of an ink ejection nozzle of the head cartridge.
Figure 17B:
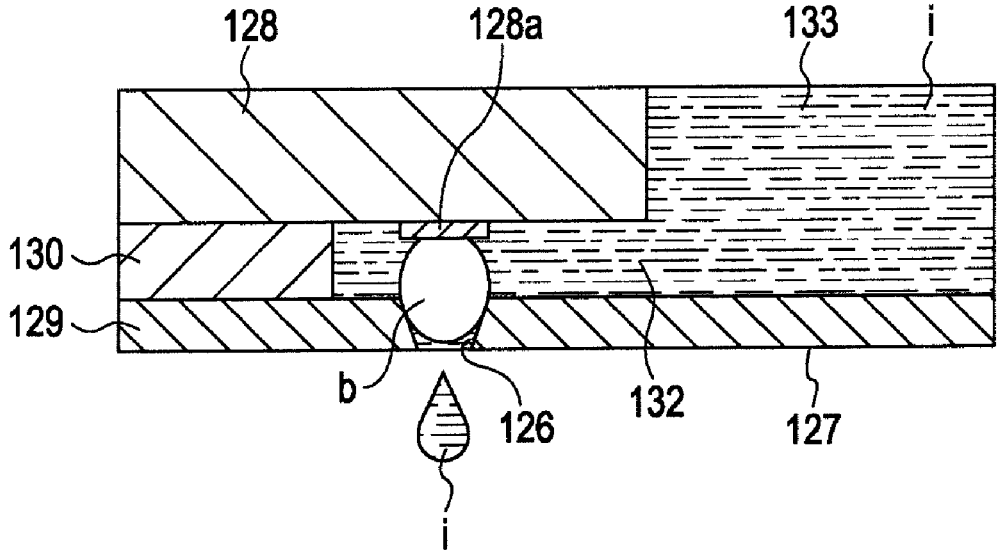

The bottom surface of the cartridge body 121, as shown in FIGS. 17A and 17B, is provided with a circuit board 128 having electrothermal heating resistors 128*a*, a nozzle sheet 129 having the ink ejection nozzles 126 formed thereon, and an ink flow path 133 formed with a barrier layer 130 provided between the circuit board 128 and the nozzle sheet 129 for supplying the ink i fed from the connector 125 to the ink ejection nozzles 126, which are formed thereon. The ink flow path 133 is longitudinally formed in a direction in that the ink ejection nozzles 126 are arranged in line, i.e., arrow W direction of FIG. 16. Thereby, the ink i flows into the ink flow path 133 from the ink cartridges 511*y*, 511*m*, 511*c*, and 511*k* via the connector 125 of the cartridge body 121 so as to supply the ink i to the ink ejection nozzles 126.

In the ink ejection nozzle 126, an ink chamber 132 is formed, which is surrounded with the circuit board 128, the nozzle sheet 129, and the barrier layer 130, for pressurizing ink with the heating resistor 128*a*. The ink chamber 132 is connected to the ink flow path 133 so that the ink i is supplied from the ink flow path 133.

In the ink ejection nozzles 126 constructed as described above, a pulse electric current is passed at a drive frequency of 9 kHz to the heating resistor 128*a* selected based on a control signal. Thereby, the ink ejection nozzle 126 rapidly heats the heating resistor 128*a*. When the heating resistor 128*a* is heated, as shown in FIG. 17A, bubbles b are generated in the ink i being in contact with the heating resistor 128*a*. Then, the ink ejection nozzle 126, as shown in FIG. 17B, pressurizes the ink i, while the bubbles b being inflated, so as to eject the pressurized ink i as liquid droplets. After the ink ejection nozzle 126 ejected the ink i as liquid droplets, the ink i is supplied to the ink chamber 132 through the ink flow path 133 so as to return again to a state before the ejection. The ink ejection nozzle 126 repeats the above operation on the basis of a control signal.

Figure 18:
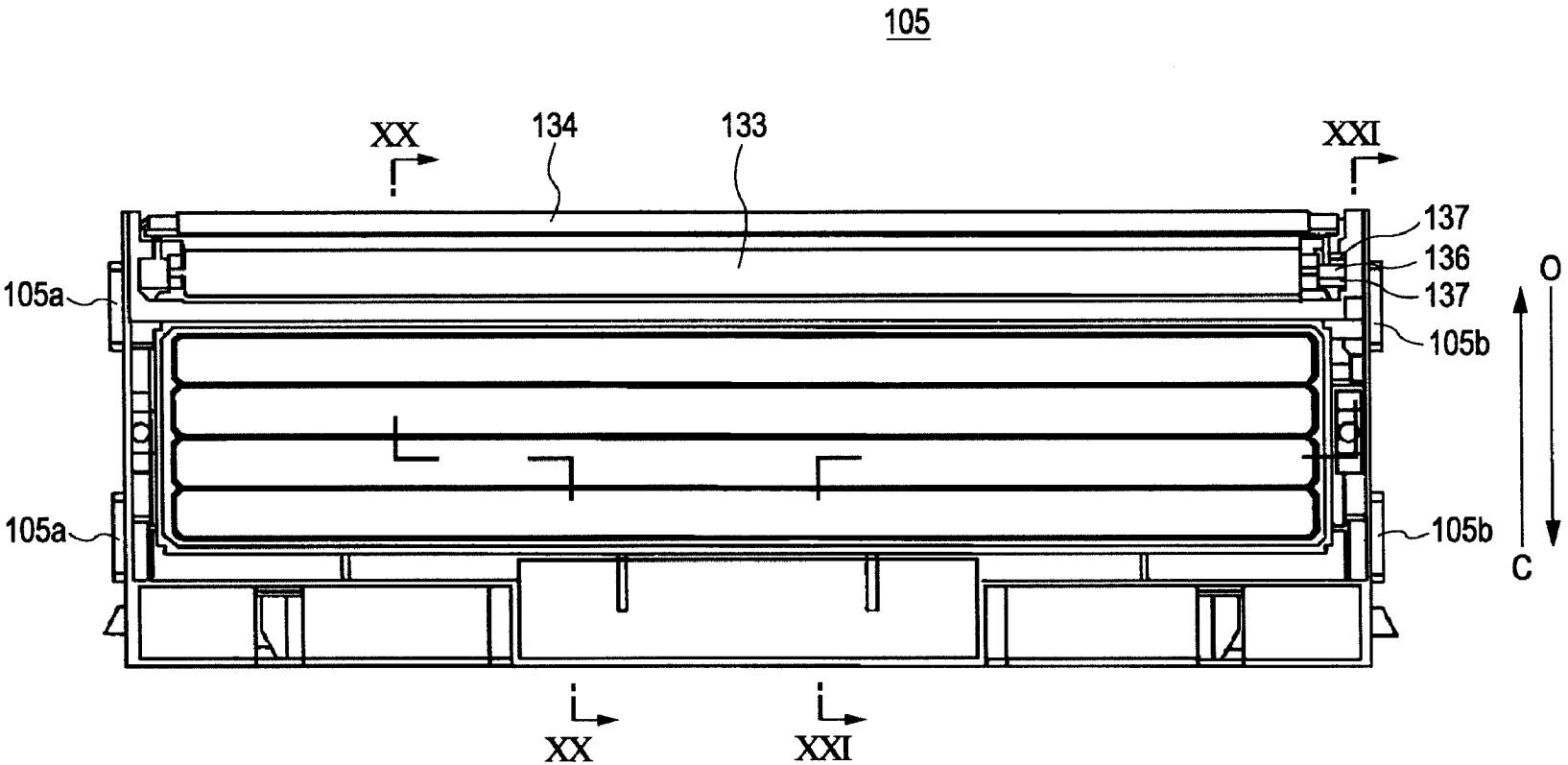
FIG. 18 is a plan view of a head cap.
Figure 19:
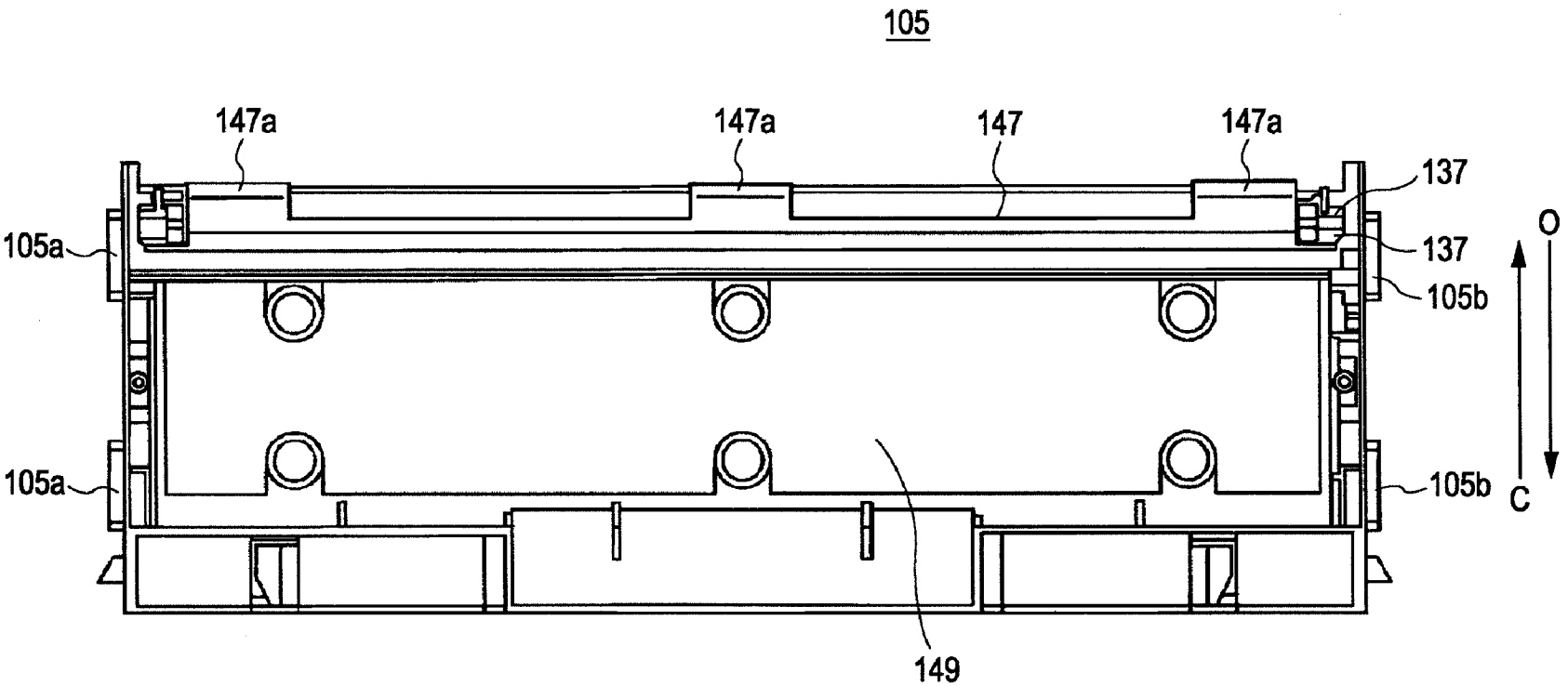
FIG. 19 is a plan view showing the interior of the head cap.
Figure 20:
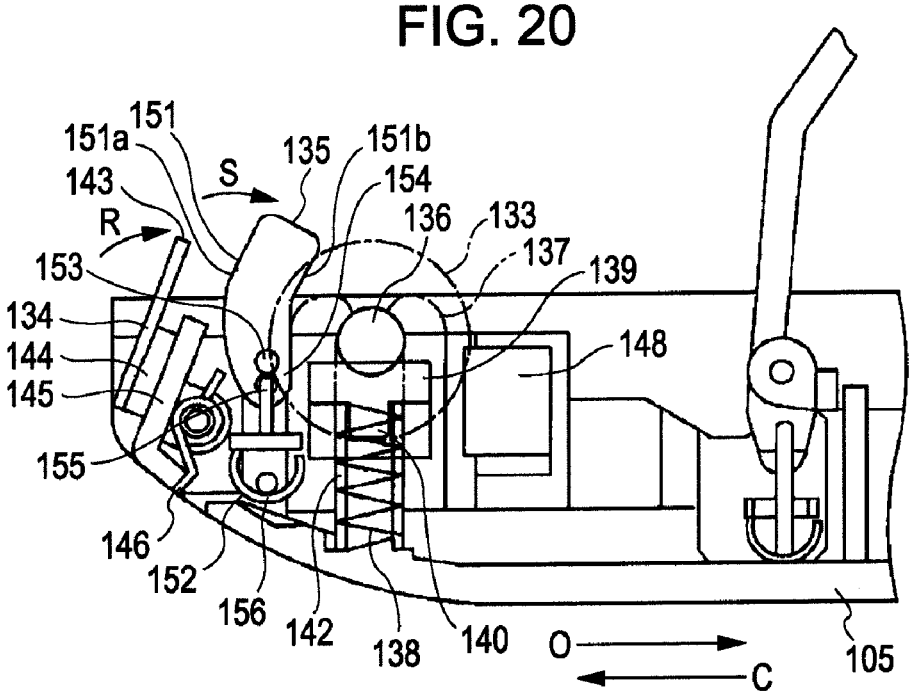
FIG. 20 is a sectional view of the head cap at the line X-X of FIG. 18.
Figure 21:
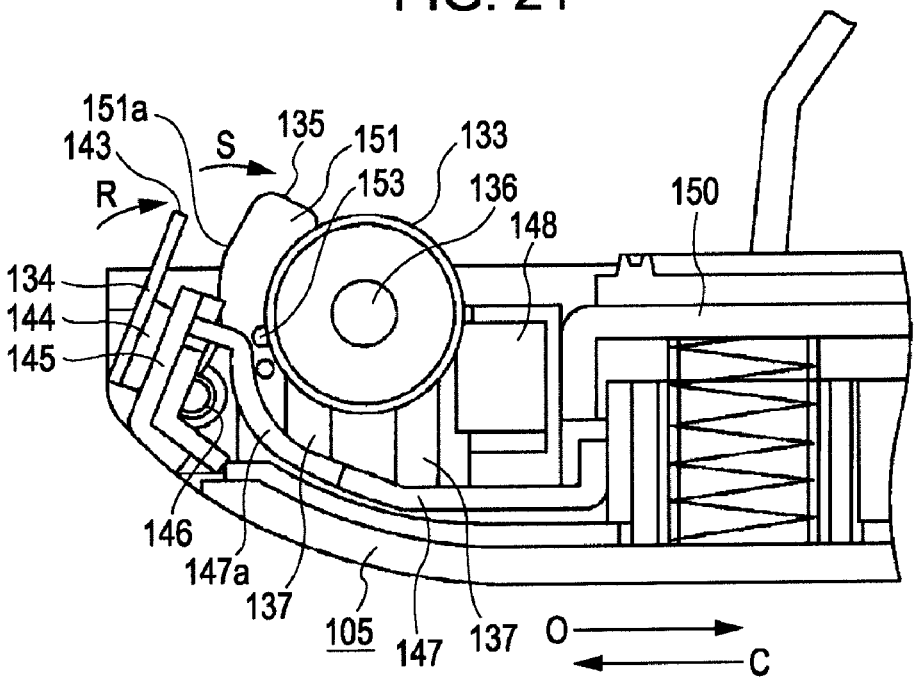
FIG. 21 is a sectional view of the head cap at the line Y-Y of FIG. 18.
Figure 22:
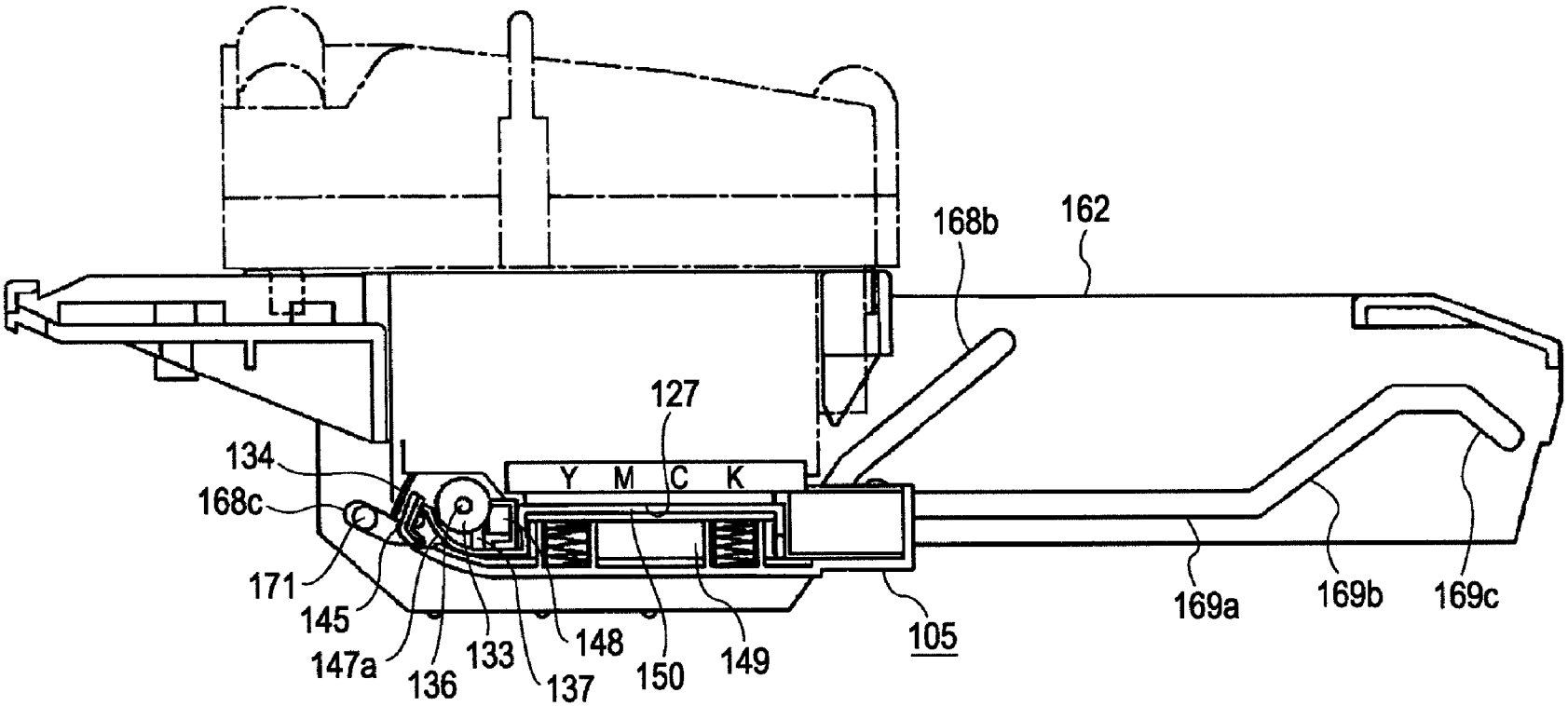
FIG. 22 is a side view of an inkjet head showing a state that the head cap covers the head cartridge.
Figure 23:
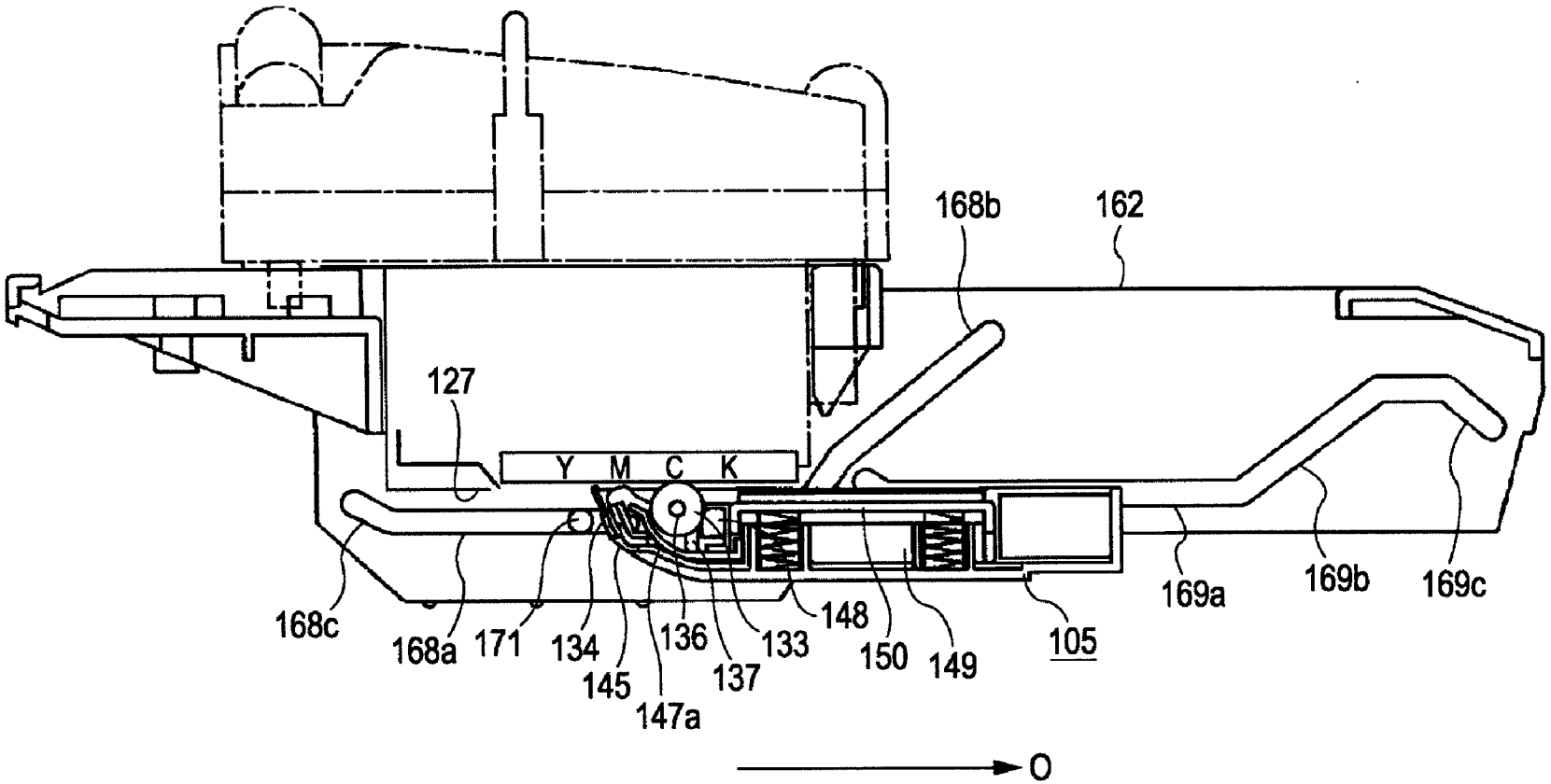
FIG. 23 is a side view of the inkjet head showing a state that the head cap opens the head cartridge.
Figure 24:
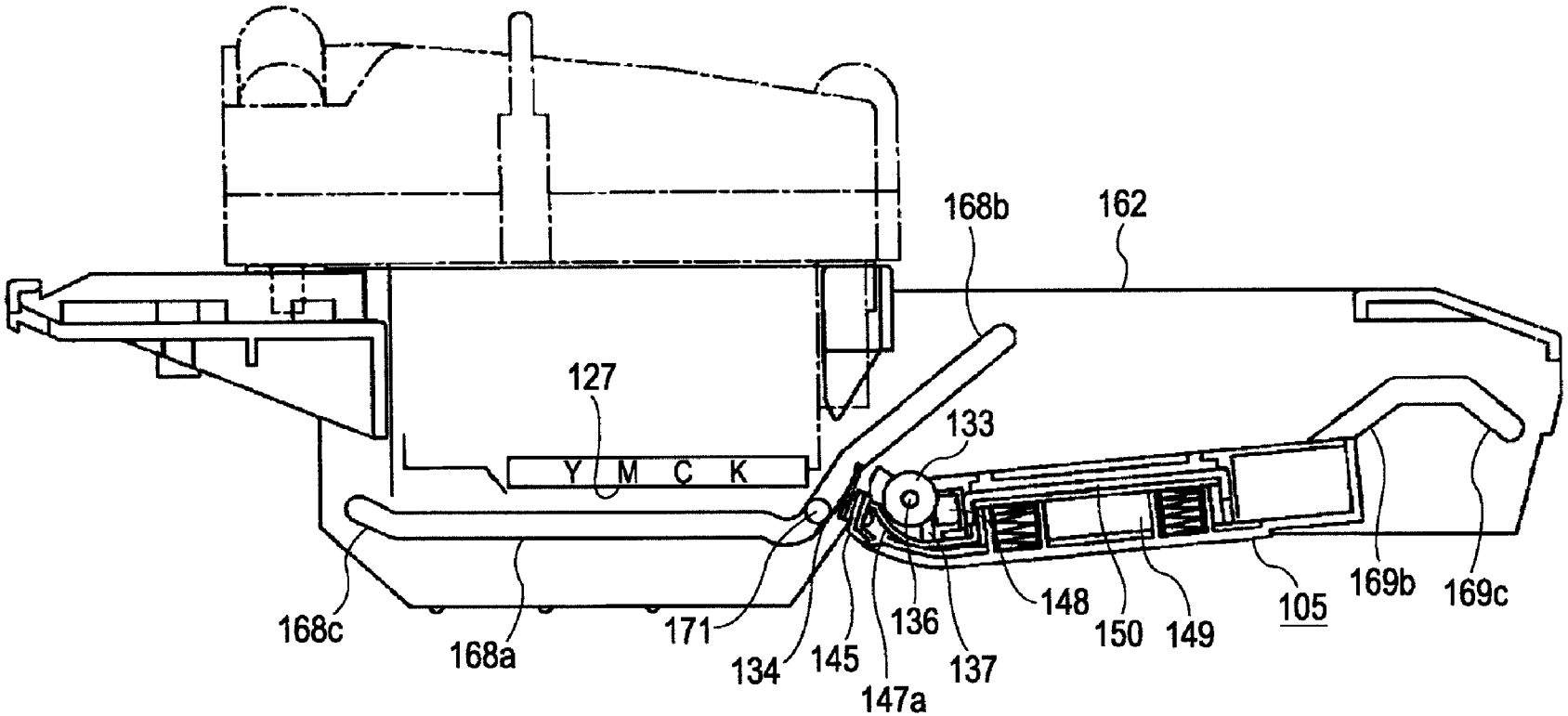
FIG. 24 is a side view of the inkjet head showing a state that the head cap opens the head cartridge.
Figure 25:
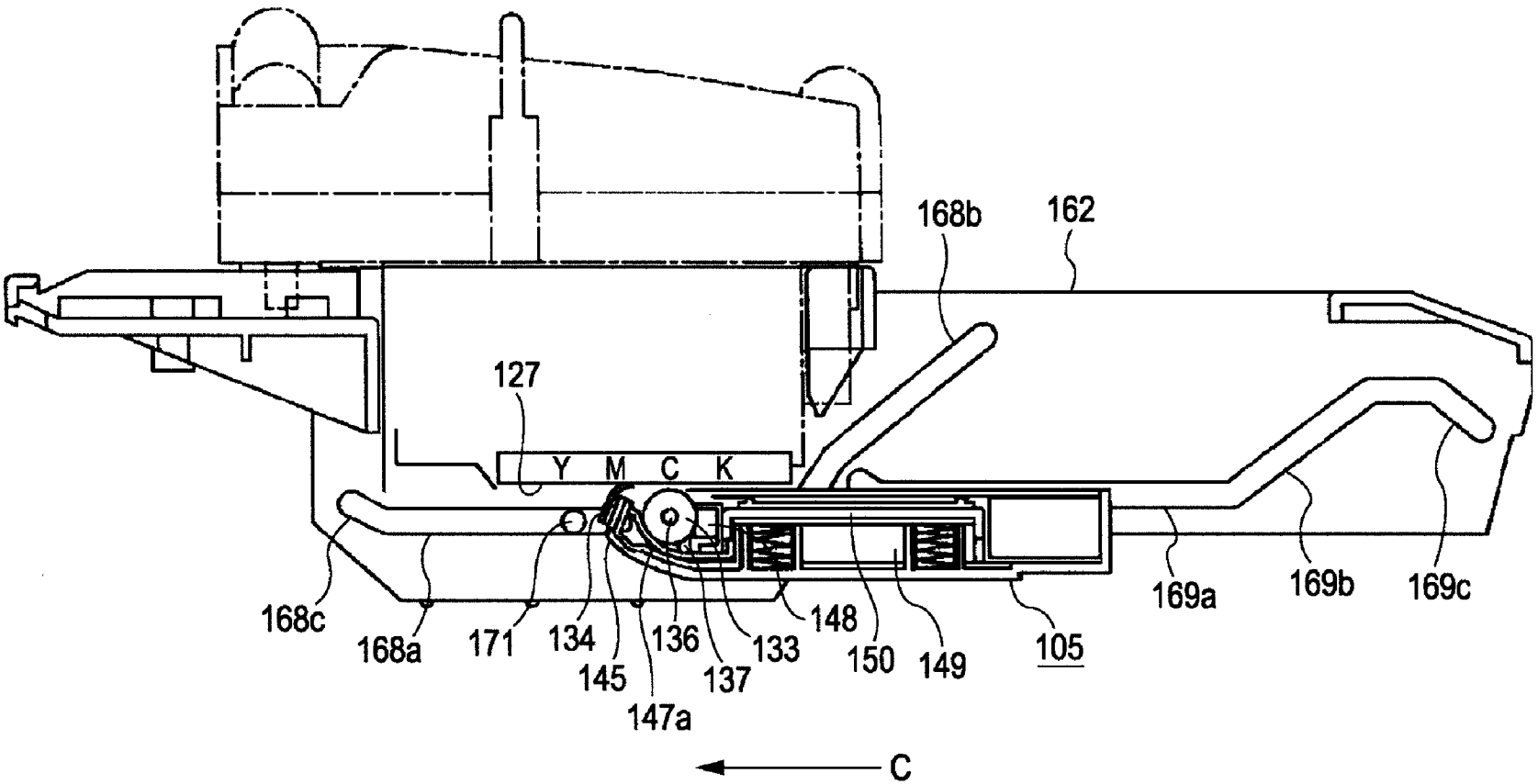
FIG. 25 is a side view of the inkjet head showing a state that the head cap covers the head cartridge.

On the ink ejection surface 127 of the liquid ejection head 104, a head cap 105 is detachably attached for protecting the ink ejection surface 127 and the ink ejection nozzles 126 against being dried. The head cap 105 will be described below with reference to FIGS. 18 to 25. FIG. 18 is a plan view of the head cap 105; FIG. 19 is a plan view of the head cap 105 without a cleaning roller 133, a cleaning blade 134, a changeover member 135, and a top plate 150, which are removed from the head cap 105 shown in FIG. 18, and will be described later; FIG. 20 is a sectional view at the line x-x of FIG. 18; and FIG. 21 a sectional view at the line y-y of FIG. 18. Also, FIG. 22 shows an initial state in that the head cap 105 covers the ink ejection surface 127; FIG. 23 shows a state in that the head cap 105 is moved in a direction opening the liquid ejection head 104; FIG. 24 shows a state in that the head cap 105 opens the liquid ejection head 104; and FIG. 25 shows a state in that the head cap 105 is moved in a direction covering the liquid ejection head 104.

The head cap 105 is detachably formed on the liquid ejection head 104 while being movable relative to the liquid ejection head 104 by a cap moving mechanism 106 below mentioned. During printing, the head cap 105 is moved in arrow O direction opening the ink ejection surface 127 so as to allow the ink ejection surface 127 to face the conveying region of the recording sheet p. At the completion of the printing, the head cap 105 covers the ink ejection surface 127 while being moved in arrow C direction covering the ink ejection surface 127 with the head cap 105 so as to protect the ink ejection surface 127.

The head cap 105 is formed of a rectangular box having raised pieces arranged at four corners, and is entirely made of a hard resin. The head cap 105 is provided with the cleaning roller 133 for cleaning the ink ejection nozzles 126 and the ink ejection surface 127, the cleaning blade 134, and the changeover member 135 for alternately switching the cleaning roller 133 and the cleaning blade 134 so as to allow them to retract from the ink ejection surface 127, which are arranged at rear portions in a direction opening the liquid ejection head 104. The head cap 105 is also provided with a scraper 148 for scraping ink stuck to the cleaning roller 133 and a sucking member 149 for sucking the ink scraped by the scraper 148, which are arranged at front portions in the direction opening the liquid ejection head 104 from the approximate center, and are covered with the top plate 150.

The cleaning roller 133 is cylindrically made of an elastic material for cleaning the ink ejection surface 127. The cleaning roller 133 is arranged in parallel with the longitudinal direction of the ink ejection surface 127 by being attached to a side face of the head cap 105 along the longitudinal direction of the head cap 105. Thereby, the cleaning roller 133 is arranged in parallel with the arranging direction of the ink ejection nozzles 126 formed along the longitudinal direction of the ink ejection surface 127. The cleaning roller 133 has a length in the longitudinal direction substantially identical or more to the arrangement length of the ink ejection nozzles 126. Thereby, the cleaning roller 133 cleans the ink ejection nozzles 126 every nozzle lines by being moved in a direction perpendicular to the arranging direction of the ink ejection nozzles 126.

Figure 26:
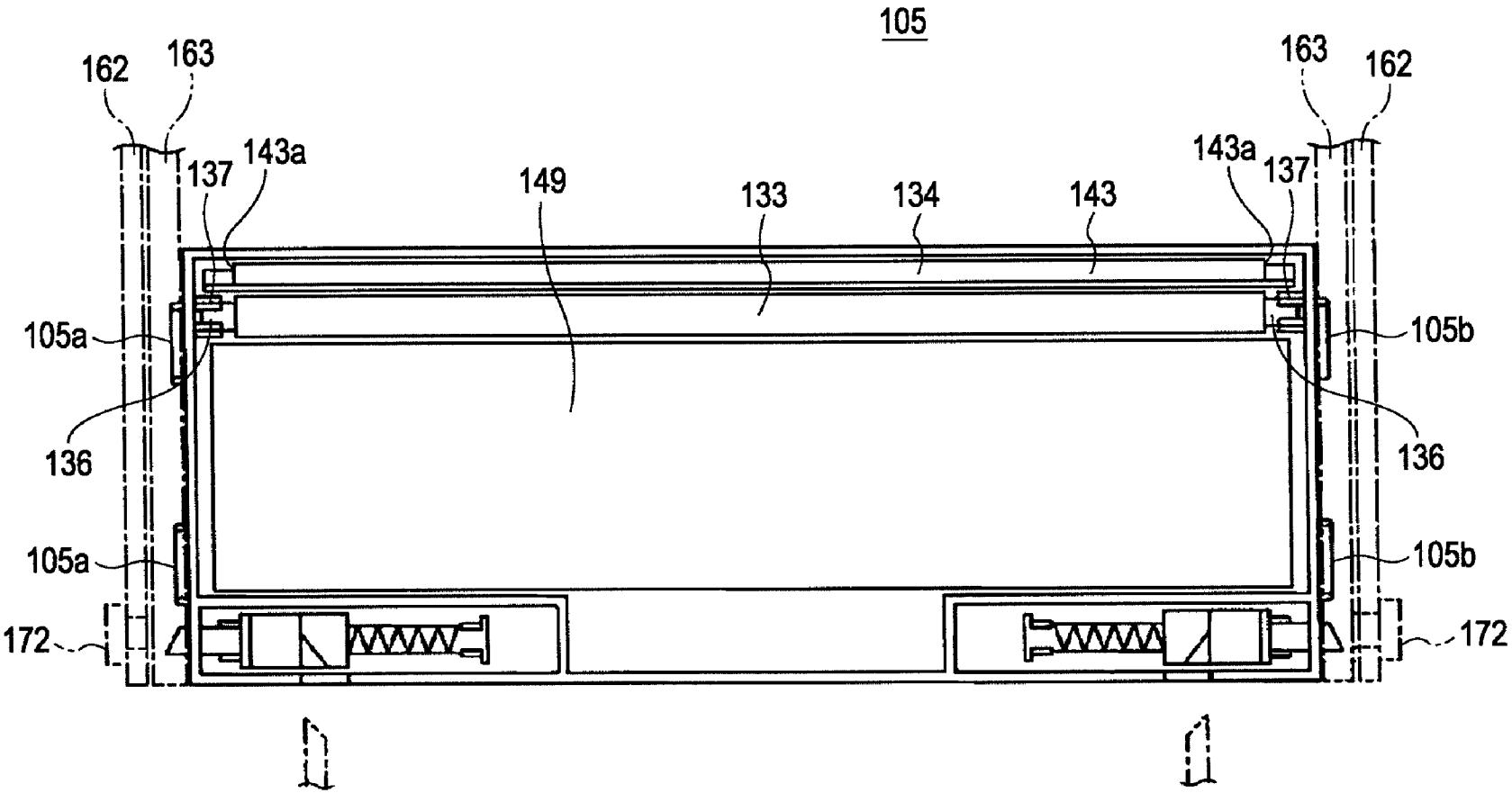
FIG. 26 is a plan view of the head cap supported by a cap movement mechanism.

The cleaning roller 133 is rotatably supported to a side face of the head cap 105 while being detachably attached to the side face of the head cap 105. That is, as shown in FIG. 26, core bars 136 are protruded from both ends of the cleaning roller 133, respectively. The core bars 136 are journaled on bearings 137 raised from the bottom surface of the head cap 105 in a substantially U-shape as shown in FIG. 20. A pin receiver arranged above the bearing 137 is elastically openable so that by pushing the core bar 136 onto the pin receiver from the top, the pin receiver is opened so as to receive the core bar 136, and then, it is closed for holding the core bar 136. Conversely, by lifting the core bar 136 upward, the pin receiver is opened so as to remove the core bar 136 therefrom.

As shown in FIG. 20, the core bar 136 is provided with a roller flange 139 to be brought into engagement with a coil spring 138 for urging the cleaning roller 133 toward the ink ejection surface 127. One side of the roller flange 139 abuts the core bar 136 while the other side forms an engagement projection 140 so as to come into engagement with the coil spring 138, which is inserted to a spindle 142 raised from the head cap 105 so as to upward urge the roller flange 139. Thereby, the cleaning roller 133 is urged on the ink ejection surface 127 by receiving the urging force of the coil spring 138 via the roller flange 139. Instead of the coil spring 138, an approximately U-shaped leaf spring may also be used for upward urging the core bar 136 according to the present invention. In this case, one end of the leaf spring is retained on the bottom surface of the head cap 105 while the other end is retained to the core bar 136 so as to upward urge the core bar 136.

The cleaning roller 133 is approximately cylindrical and is so-called crown-shaped in which the center part in the longitudinal direction becomes gradually larger in diameter. Since the center part in the longitudinal direction may downward deflect, this prevents the cleaning roller 133 from being out of contact with the ink ejection surface 127 due to the deflection.

The cleaning roller 133, on surfaces of contact with the ink ejection surface 127, is made of an elastic and porous resin absorbing liquid, such as ethylene propylene rubber, chloroprene rubber, or urethane rubber. A core of the cleaning roller 133 is made of a metal or a hard resin. A detergent solution is soaked on surfaces of contact with the ink ejection surface 127 of the cleaning roller 133.

The peripheral length of the cleaning roller 133 may be the same as the movement distance of the cleaning roller 133 which moves on the ink ejection surface 127 while being rotated in a state of contact with the ink ejection surface 127. In this case, a point of contact, at which the cleaning roller 133 driven-rolling on the ink ejection surface 127 cleans a predetermined position of the ink ejection surface 127, cannot clean another position of the ink ejection nozzles 126 again, so that the ink ejection nozzles 126 and the ink ejection surface 127 can be stably cleaned.

The elastic and crown-shaped cleaning roller 133 is moved from the initial state in that the head cap 105 covers the liquid ejection head 104 as shown in FIG. 22 in arrow O direction in that the head cap 105 opens the ink ejection surface 127 as shown in FIG. 23. The cleaning roller 133 abuts the ink ejection surface 127 over the entire length in the longitudinal direction by the urging force of the coil spring 138. Then, the cleaning roller 133 is further moved in the direction opening the ink ejection surface 127 in an abutted state to the ink ejection surface 127 so as to roll or slide on the ink ejection surface 127 while being driven for sucking the ink i remaining on the ink ejection surface 127 and the ink ejection nozzles 126. Since a detergent solution is soaked on cleaning roller surfaces of contact with the ink ejection surface 127 at this time, the wettability to ink is excellent. When the cleaning roller 133 comes into contact with the ink ejection nozzle 126, between the cleaning roller 133 and the ink ejection surface 127, an ink layer is instantaneously formed, which redissolves thickened ink. After the redissolution, the ink is sucked by the cleaning roller 133 with high wettability, facilitating the cleaning. By the movement of the head cap 105 from the position covering the liquid ejection head 104 shown in FIG. 22 to the position opening the liquid ejection head 104 shown in FIG. 24, the cleaning roller 133 can clean the ink ejection surface 127 over the entire surface.

When the head cap 105 is moved in arrow C direction of FIG. 25 covering the ink ejection surface 127, the core bar 136 is downward pushed against the urging force of the coil spring by the changeover member 135, which will be described later, so that the cleaning roller 133 is retracted from the ink ejection surface 127. That is, if the cleaning roller 133 is driven-rolled or slid on the ink ejection surface 127 even after the printing, unused ink contained in the ink chamber 132 is excessively sucked uneconomically so that the sucking function of the cleaning roller 133 is deteriorated, reducing the roller life. Whereas, in the inkjet printer 101, during covering the liquid ejection head 104, the cleaning roller 133 is retracted from the ink ejection surface 127 so as not to perform the cleaning, preventing such a problem.

Next, the cleaning blade 134 will be described, which is arranged in the vicinity of the cleaning roller 133 on the left of FIG. 18. The cleaning blade 134 is for wiping the thickened ink and contaminant by moving over the ink ejection surface 127. As shown in FIGS. 20 and 21, the cleaning blade 134 includes a wiping unit 143 made of elastic thin plate-like rubber and a support plate 144 for supporting the wiping unit 143. The support plate 144 is attached on the bottom surface of the head cap 105 via a holder 145 rotatably in the moving direction of the head cap 105. The cleaning blade 134, in the same way as in the cleaning roller 133, is attached along the longitudinal direction of the head cap 105 so as to be in parallel with the longitudinal direction of the ink ejection surface 127. When the head cap 105 is moved, the cleaning blade 134 is abutted on the ink ejection surface 127 so as to slide thereon while being deflected for wiping the thickened ink and contaminant adhered on the ink ejection surface 127.

The wiping unit 143 to be slid on the ink ejection surface 127 is made of a substantially rectangular molded resin such as rubber with the outer periphery removed. Thereby, the wiping unit 143 has about right-angled corners so as to securely wipe the thickened ink and contaminant adhered on the ink ejection surface 127.

The support plate 144 is made of a hard material such as a metallic plate for supporting the wiping unit 143. The support plate 144 is made integrally with the wiping unit 143 by taking it out of a predetermined mold in which the feed stock resin for the wiping unit 143 has been poured.

The holder 145 for rotatably supporting the support plate 144 is attached on the bottom surface of the head cap 105 rotatably in the moving direction of the head cap 105 so as to rotatably hold the cleaning blade 134. The holder 145 has an approximately L-shaped cross section and includes the support plate 144 attached on one side and a helical torsion coil spring 146, which is retained to the head cap 105 at one end, retained at the other end on the other side. Thereby, the holder 145 is always urged in r direction of FIG. 20 that faces the ink ejection surface 127.

When the head cap 105 is moved from the initial state in that the head cap 105 covers the liquid ejection head 104 as shown in FIG. 22 in arrow O direction in that the head cap 105 opens the ink ejection surface 127 as shown in FIG. 23 by the below-mentioned cap moving mechanism 106, the holder 145 is rotated in anti-arrow R direction of FIG. 20 by the below-mentioned changeover member 135, so that the wiping unit 143 of the cleaning blade 134 is retracted from the ink ejection surface 127. When the head cap 105 is moved from the open position shown in FIG. 24 where the head cap 105 opens the liquid ejection head 104 in arrow C direction of FIG. 25 covering the liquid ejection head 104, the urging force due to the below-mentioned changeover member 135 is released, and by the urging force due to the helical torsion coil spring 146, the cleaning blade 134 is rotated in arrow R direction of FIG. 20, and the wiping unit 143 is allowed to face the ink ejection surface 127. Then, by the movement of the head cap 105, the wiping unit 143 slides on the ink ejection surface 127 so as to wipe out the ink and contaminants adhered on the ink ejection surface 127.

At this time, in order to prevent the cleaning blade 134 from excessively falling over the bottom surface of the head cap 105 due to sliding on the ink ejection surface 127, the holder 145 is supported by a stopper plate 147. The stopper plate 147 made of an elastic rectangular plate-like member, such as a leaf spring, is arranged at the rear end of the head cap 105 along the longitudinal direction. The stopper plate 147 is provided with a support part 147*a* for supporting the holder 145 by abutting the surface of the holder 145 opposite to that to which the support plate 144 is attached, and an end of the support part 147*a* is extended to the rotational region of the holder 145. In the stopper plate 147, when the holder 145 is inclined in arrow R direction of FIG. 21 by the sliding of the wiping unit 143 on the ink ejection surface 127, the support part 147*a* is abutted to the holder 145 so as to prevent the cleaning blade 134 from being further inclined in arrow R direction. Thereby, the stopper plate 147 can prevent the cleaning blade 134 from excessively falling over, so that the wiping unit 143 can be slid on the liquid ejection head 104 at a predetermined pressure. This prevents the cleaning efficiency of the ink ejection surface 127 by the wiping unit 143 from being deteriorated.

Then, the changeover member 135 for switching the cleaning roller 133 and the cleaning blade 134 will be described. The changeover member 135 is arranged between the cleaning roller 133 and the cleaning blade 134 for switching the cleaning roller 133 and the cleaning blade 134, which are rollably or slidably urged on the ink ejection surface 127, to be alternately retracted from the ink ejection surface 127 in accordance with the opening/closing movement of the head cap 105. The changeover member 135 includes a switch 151 for urging the core bar 136 of the cleaning roller 133 and the holder 145 of the cleaning blade 134 and a switch spring 152 for vertically urging the switch 151.

The switch 151 is inflected in an approximate chevron shape, and includes a support hole 153 formed at the lower end. By inserting a rolling pin protruded from a support piece raised from the bottom surface of the head cap 105 into the support hole 153, the switch 151 is rotatably supported in arrow S direction and anti-arrow S direction of FIG. 20, which are the moving directions of the head cap 105. The switch 151 includes the switch spring 152 having a retainer hole 154 formed below the support hole 153.

The switch spring 152 is provided with a retainer 155 for retaining the retainer hole 154 and an annular part 156 for retaining a retainer pin protruded from a support piece raised from the bottom surface of the head cap 105. By downward urging the switch 151, the switch spring 152 always rotates the switch 151 about the retainer hole 154 in a vertical direction in that the switch 151 is not abutted to the core bar 136 as well as to the holder 145.

When the head cap 105 is moved in arrow O direction of FIG. 23 opening the ink ejection surface 127, such a changeover member 135 is rotated in anti-arrow S direction of FIG. 20 against the urging force of the switch spring 152 by pushing the switch 151 to the ink ejection surface 127. Thereby, one side face 151*a* of the switch 151 pushes the holder 145 so as to rotate the cleaning blade 134 against the urging force of the helical torsion coil spring 146 in anti-arrow R direction of FIG. 20 for retracting the wiping unit 143 from the ink ejection surface 127. On the other hand, since the core bar 136 is not pushed by the switch 151, the cleaning roller 133 is allowed to abuttably face the ink ejection surface 127 by the urging force of the coil spring 138. Hence, when the head cap 105 is moved in arrow O direction of FIG. 23 opening the ink ejection surface 127, the cleaning is switched so that only the cleaning roller 133 cleans the ink ejection surface 127 while the cleaning blade 134 does not clean. Thereby, the excessive sliding of the cleaning blade 134 after the cleaning by the cleaning roller 133 can be suppressed so as to protect the ink ejection nozzles 126 and the ink ejection surface 127 as well as to prevent the cleaning blade 134 from deteriorating.

When the head cap 105 is moved in arrow C direction of FIG. 25 covering the ink ejection surface 127, the changeover member 135 is rotated in arrow S direction of FIG. 20 against the urging force of the switch spring 152 with the pushed switch 151 by the ink ejection surface 127. Thereby, the other side face 151*b* of the switch 151 adjacent to the roller abuts the core bar 136 so as to retract the cleaning roller 133 from the ink ejection surface 127 against the urging force of the coil spring 138. On the other hand, since the holder 145 is not pushed by the switch 151, the cleaning blade 134 is allowed to abuttably face the ink ejection surface 127 by the urging force of the helical torsion coil spring 146. Hence, when the head cap 105 is moved in arrow C direction of FIG. 25 covering the ink ejection surface 127, the cleaning is switched so that only the cleaning blade 134 cleans the ink ejection surface 127 while the cleaning roller 133 does not clean.

The switch 151 is inflected in an approximate chevron shape as mentioned above, so that the other side face 151*b* of the switch 151 adjacent to the roller is formed in a concave shape. Hence, when the switch 151 is rotated in arrow S direction of FIG. 20 which is on the side of the cleaning roller 133, the concave other side face 151*b* can be securely brought into engagement with the core bar 136 for pushing it so as to retract the cleaning roller 133 from the position sliding on the ink ejection surface 127.

The one side face 151*a* of the switch 151 adjacent to the cleaning blade 134 is bulged in a circular arc. Hence, when the switch 151 is rotated in anti-arrow S direction of FIG. 20, which is on the side of the cleaning blade 134, the one side face 151*a* bulged in a circular arc gradually pushes the holder 145 and smoothly rotates the holder 145 so as to retract the wiping unit 143 from the position sliding on the ink ejection surface 127.

The apex of the switch 151, which is held in sliding contact with the ink ejection surface 127, is shaped in a circular arc. Hence, the switch 151 can be smoothly rotated without impairing the ink ejection surface 127 also when slidably engaging the ink ejection surface 127.

Then, the scraper 148, the sucking member 149, and the top plate 150 for removing foreign materials such as contaminants on the cleaning roller 133 will be described. The scraper 148 has fine unevenness for facilitating the removal of foreign materials on the cleaning roller 133 and is made of a roughly rectangular material, such as sponge, for slightly sucking ink on the cleaning roller 133, so that it is arranged along the longitudinal direction of the head cap 105. The scraper 148 is arranged at a position close to the center of the head cap 105, where can slidably engage the cleaning roller 133 along the longitudinal direction. The scraper 148 scrapes ink and contaminants adhered on the cleaning roller 133 when the cleaning roller 133 having them rotates in sliding contact with the scraper 148. The scraper 148 is also held in contact with the sucking member 149 so that the ink sucked from the cleaning roller 133 is held by the sucking member 149.

The sucking member 149 made of a sheet material for sucking and holding ink, such as non-woven fabric, is arranged along the longitudinal direction of the head cap 105. The sucking member 149 is arranged toward the end along the movement direction of the head cap 105 opening the liquid ejection head 104. The sucking member 149 has a capillary force larger than that of the scraper 148 so as to such and hold the ink scraped by the scraper 148. Thereby, the cleaning roller 133 and the scraper 148 cannot be saturated with the sucked ink so as to maintain the performance of cleaning the ink ejection nozzles 126 and the ink ejection surface 127. The sucking member 149 is arranged over a wide range from the substantial center of the head cap 105 to its end so as to hold a certain amount of ink.

Since the top of the sucking member 149 is covered with the top plate 150, also when the head cap 105 covers the liquid ejection head 104, the sucking member 149 cannot directly face the ink ejection surface 127, preventing the ink ejection surface 127 from being contaminated with the ink suck and held by the sucking member 149.

In addition, on the bottom surface of the head cap 105, a spent ink tray is provided between the cleaning roller 133 and the cleaning blade 134. The spent ink tray is made of absorbents capable of adsorbing ink such as sponge. In order to stabilize the ink ejection performance from the ink ejection nozzles 126, the spent ink tray adsorbs the spent ink ejected by the preliminary ejection performed before the printing after the cleaning.

Figure 27:
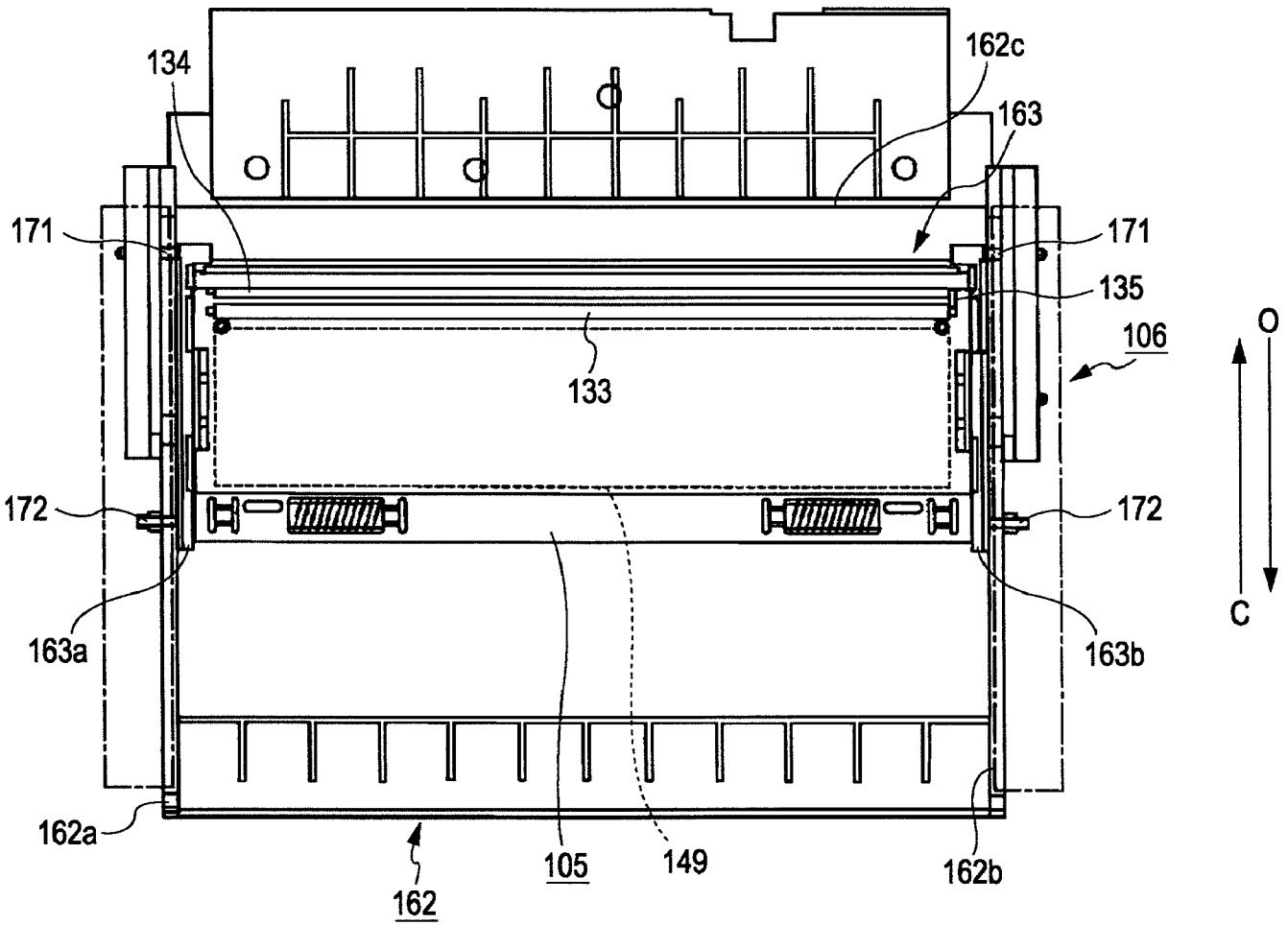
FIG. 27 is a plan view of the cap movement mechanism.

Then, the cap movement mechanism 106 for moving the head cap 105 in opening/closing directions of the liquid ejection head 104 will be described. The cap movement mechanism 106, as shown in FIGS. 21 and 27, includes a frame member 162 assembled on a side of a chassis arranged in the printer body 102, a head cap holder 163 combined with the frame member 162 slidably in the longitudinal direction of the printer body 102, a rack plate 164 arranged between a chassis side 161 and the frame member 162 to be moved in the longitudinal direction of the printer body 102, and a drive motor 165 for moving the rack plate 164 via a worm gear 166.

The frame member 162, integrally made of a frame-like synthetic resin, is fixed to the chassis arranged in the printer body 102. The frame member 162 supports a head cap holder 163 holding the below-mentioned head cap 105 movably along the longitudinal direction of the printer body 102, and has a length ranging from the printing position to the front of the printer body 102.

Figure 28:
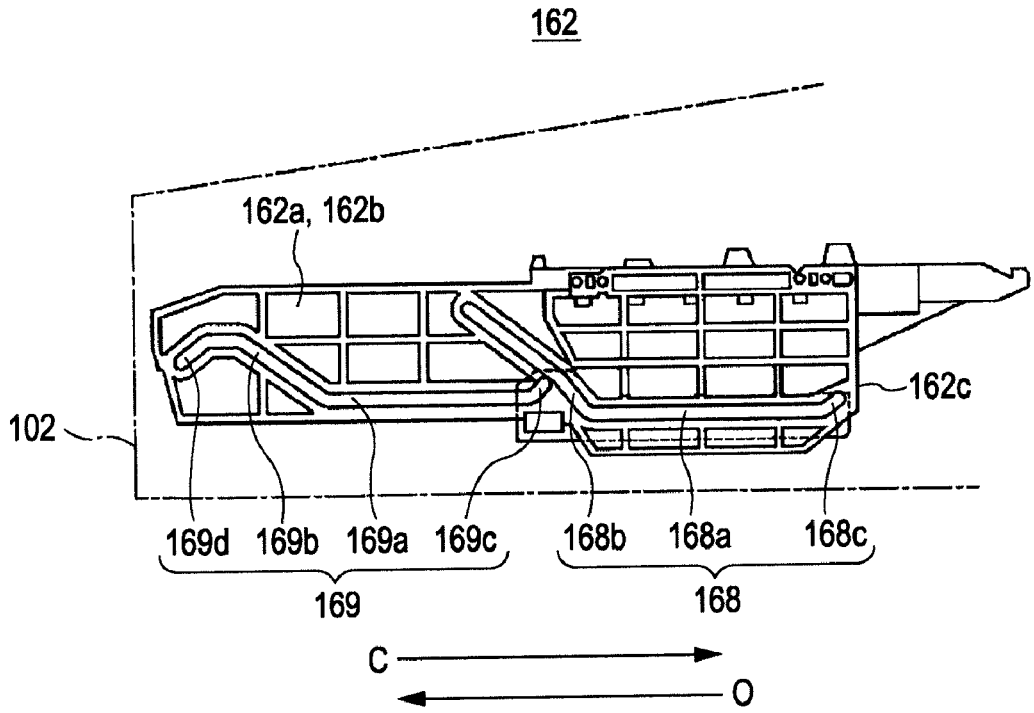
FIG. 28 is a side view of a frame member.

The frame member 162, as shown in FIG. 28, includes both longitudinal side frames 162*a* and 162*b* facing each other, each having first and second guide grooves 168 and 169 formed thereon, each being a bilaterally symmetrical through groove. The first guide groove 168 is formed in accordance with the printing position of the printer body 102, and includes a horizontal groove 168*a* extending from the vicinity of a side 162*c* on the back of the printer body 102 toward the front and an inclined groove 168*b*, which is communicated with the horizontal groove 168*a* at its front end and upward inclined toward the front. The rear end 168*c* of the horizontal groove 168*a* is upward inclined toward the back. The second guide groove 169 includes a horizontal groove 169*a*, which is horizontally extended toward the front from the substantial center of the side frames 162*a* and 162*b* from where the inclined groove 168*b* of the first guide groove 168 starts rising, an inclined groove 169*b*, which is communicated with the horizontal groove 169*a* at its front end and upward inclined toward the front, and a curved groove 169*d*, which is curved from the end of the inclined groove 169*b* and inclined downward. The rear end 169*c* of the horizontal groove 169*a* is also upward inclined toward the back.

In the frame member 162, the space between the horizontal groove 168*a* and the rear end 168*c* of the first guide groove 168 is substantially the same as that between the horizontal groove 169*a* and the rear end 169*c* of the second guide groove 169, and it is also substantially the same as the overall depth of the head cap 105 perpendicular to the width thereof. Also, in the frame member 162, the space between the front end of the inclined groove 169*b* and the front end of the curved groove 169*d* of the second guide groove 169 is substantially the same as the overall depth of the head cap 105.

The head cap holder 163, supported with such a frame member 162 movably along the longitudinal direction of the printer body 102, is formed in a frame shape by connecting between sides 163*a* and 163*b*, which are molded of a synthetic resin and facing each other, with a plurality of metallic beams while the space between the sides 163*a* and 163*b* being maintained constant. When the head cap 105 is mounted, the head cap holder 163 moves the head cap 105 along the first guide groove 168 and the second guide groove 169 in the longitudinal direction of the printer body 102.

In the head cap holder 163, on the inner sides 163*a* and 163*b*, there are provided horizontal guide grooves (not shown) with which guide projections 105*a* and 105*b* (see FIG. 26) protruded from the head cap 105 are brought into engagement. The guide grooves are forward opened from the sides 163*a* and 163*b*, respectively. By inserting the guide projections 105*a* and 105*b* into the openings, the head cap 105 is assembled.

The head cap holder 163, as shown in FIG. 27, also includes a first guide roller 171 and a second guide roller 172 spaced in the longitudinal direction and provided on the respective sides 163*a* and 163*b*. In the head cap holder 163, the first guide rollers 171 are fitted into the first guide grooves 168 of the frame member 162 while the second guide rollers 172 are fitted into the second guide grooves 169. Thereby, the head cap holder 163 is slidable guided with the frame member 162 along the longitudinal direction of the printer body 102.

Specifically, in the head cap holder 163, when the first guide roller 171 is located at the rear end 168*c* of the first guide groove 168 while the second guide roller 172 is located at the rear end 169*c* of the second guide groove 169, the head cap 105 is held at the position covering the ink ejection surface 127. Also, in the head cap holder 163, when the first and second guide rollers 171 and 172 are moved forward inside the first and second guide grooves 168 and 169, and located above the inclined grooves 168*b* and 169*b*, respectively, the head cap 105 is held at the retracted position opening the ink ejection surface 127.

The head cap holder 163 may be further moved forward from the retracted position so as to clean the front with the cleaning blade 134. That is, when the head cap holder 163 is moved to the retracted position, in a state of the first guide roller 171 located at the front end of the inclined groove 168*b*, the second guide roller 172 is moved along the curved groove 169*d* of the second guide groove 169. Thereby, the head cap holder 163 moves the head cap 105 to the cleaning position on the front side of the printer body 102 while the front is downward inclined using the first guide roller 171 as a fulcrum. At the cleaning position, a sucking sheet for sucking ink adhered on the cleaning blade 134 is arranged above the head cap 105 so that the cleaning blade 134 slidably engages the sucking sheet by the movement of the head cap 105. Thereby, the cleaning blade 134 is cleaned, maintaining the cleaning performance.

Figure 29:
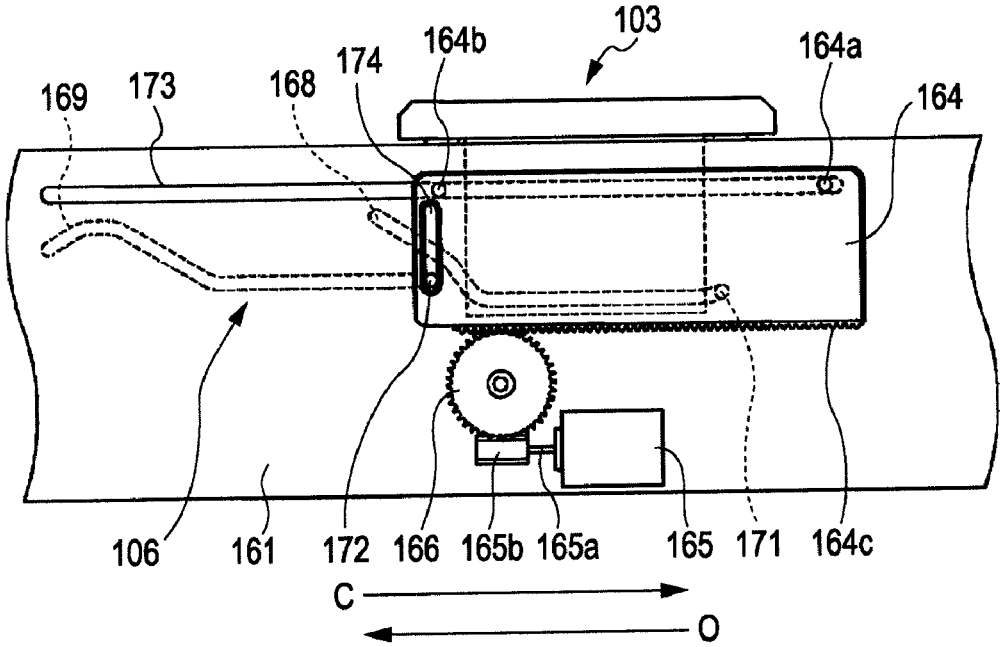
FIG. 29 is a side view showing a chassis side and a rack plate.
Figure 30:
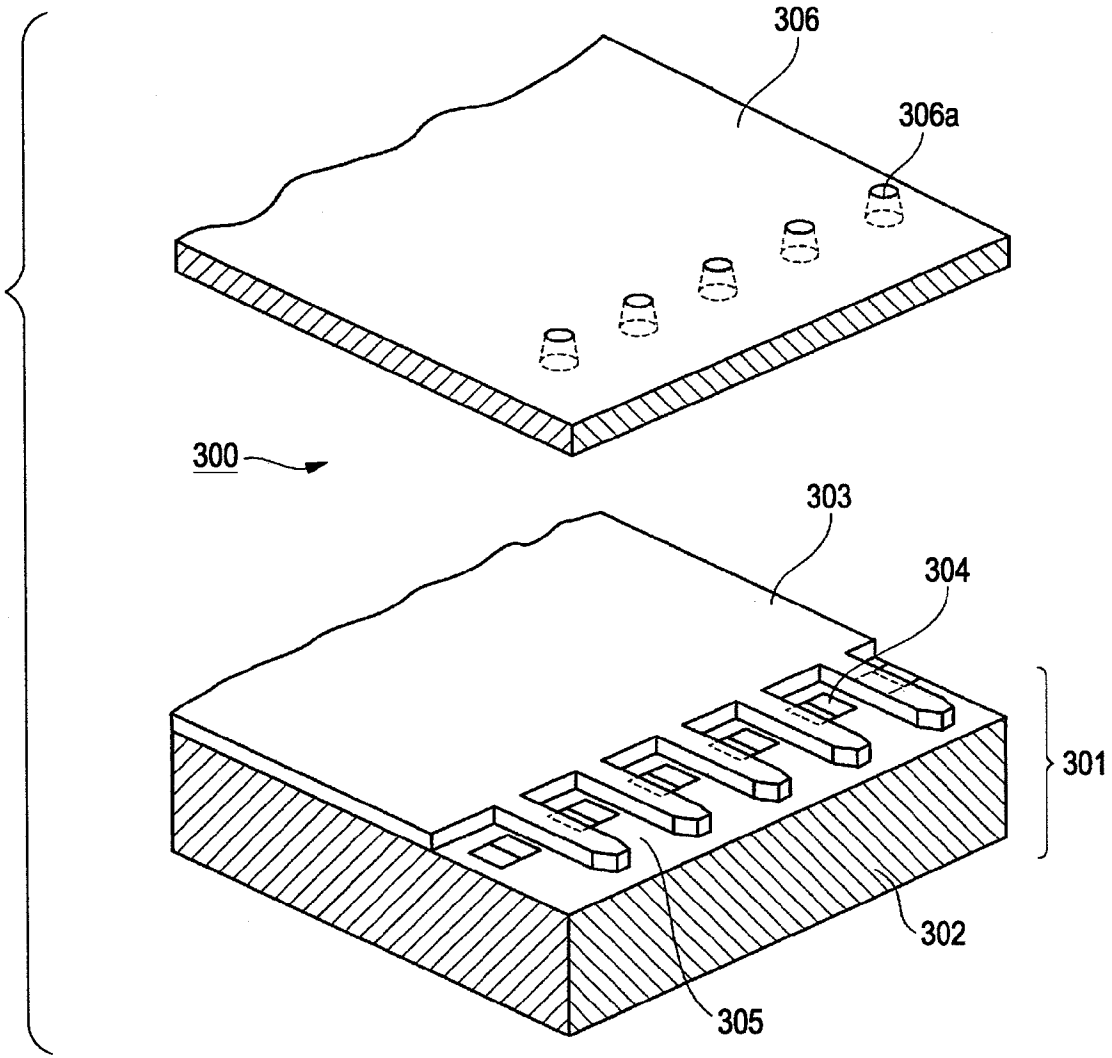
FIG. 30 is a partial perspective view of a conventional head.

On the chassis side 161 for fixing the frame member 162, as shown in FIG. 29, a horizontally extended third guide groove 173 is arranged above the first guide groove 168 and the second guide groove 169. With the third guide groove 173, a pair of cam pins 164*a* and 164*b* arranged on the side of the below-mentioned rack plate 164 and spaced in the longitudinal direction are engaged. Then, by the rolling of the cam pins 164*a* and 164*b*, the third guide groove 173 guides the movement of the rack plate 164 along the chassis side 161 in the longitudinal direction.

The rack plate 164, which is guided to move along the chassis side 161, is formed in an approximate rectangular plate-shape and includes a rack 164*c* arranged on the lower edge over the substantially entire length. The rack 164*c* is mated with the worm gear 166 driven by the drive motor 165 attached on the chassis side 161. Thereby, by driving of the drive motor 165, the rack plate 164 is moved along the chassis side 161 via the cam pins 164*a* and 164*b* engaged with the third guide groove 173.

The rack plate 164 is provided with a cam groove 174 formed at the front in the height direction. With the cam groove 174, the second guide roller 172, which is provided in the head cap holder 163, is engaged through a second guide groove 157. Thereby, the vertical movement of the second guide roller 172 is guided, enabling the head cap holder 163 to move along the first and second guide grooves 168 and 169 of the frame member 162.

In the cap movement mechanism 106 configured as described above, when the head cap 105 is moved from the covering position covering the liquid ejection head 104 in the initial state to the open position opening the liquid ejection head 104 for printing, the drive motor 165 is driven on the basis of a control signal from the below-mentioned control unit 107. When the worm gear 166 is driven via the output shaft 165*a* of the drive motor 165 and the worm, the rack plate 164 engaged with the worm gear 166 is moved to the front of the printer body 102 in the horizontal direction guide with the third guide groove 173 having the cam pins 164*a* and 164*b* formed on the chassis side 161.

At this time, since the rack plate 164 moves so as to pull the second guide roller 172 engaged with the cam groove 174, the head cap holder 163 having the second guide roller 172 is moved in the front of the printer body 102 in accordance with the movement of the rack plate 164. In the head cap holder 163, the first guide roller 171 moves along the first guide groove 168 of the frame member 162 while the second guide roller 172 moves along the second guide groove 169 of the frame member 162.

Since the second guide roller 172 is moved along the third guide groove 173 formed along the height direction of the rack plate 164, the head cap holder 163 can move in the height direction so that the first and second guide rollers 171 and 172 can move from the horizontal grooves 168*a* and 169*b* toward the inclined grooves 168*b* and 169*b* of the first and second guide grooves 168 and 169 formed in the frame member 162, respectively. Thereby, the head cap holder 163 moves upward at the front of the printer body 102 after being horizontally moved from the printing position to the front of the printer body 102 so as to be maintained forward-tilted in accordance with the shape of the printer body 102. Hence the head cap 105 held by the head cap holder 163 is moved from the covering position to the opening position of the liquid ejection head 104 while at the opening position, the head cap 105 is retracted from the conveying region of the recording sheet p.

When the head cap 105 is provided with the sucking sheet for cleaning the cleaning blade 134 at the retracted position of the liquid ejection head 104 as mentioned above, the wiping unit 143 of the cleaning blade 134 is brought into sliding contact with the sucking sheet along with the opening operation of the liquid ejection head 104 so as to suck the ink adhered. Thereby, the cleaning blade 134 is cleaned so as to maintain its cleaning performance.

When the head cap holder 163 is moved to the position, at which the head cap 105 opens the liquid ejection head 104, the drive motor 165 is stopped so as to start printing. At the completion of the printing, the drive motor 165 is driven on the basis of a control signal from the control unit 107, so that by the operation reverse to that for opening the liquid ejection head 104 described above, the head cap holder 163 is moved to the printing position of the printer body 102 so as to return the head cap 105 to the covering position of the liquid ejection head 104.

Figure 12:
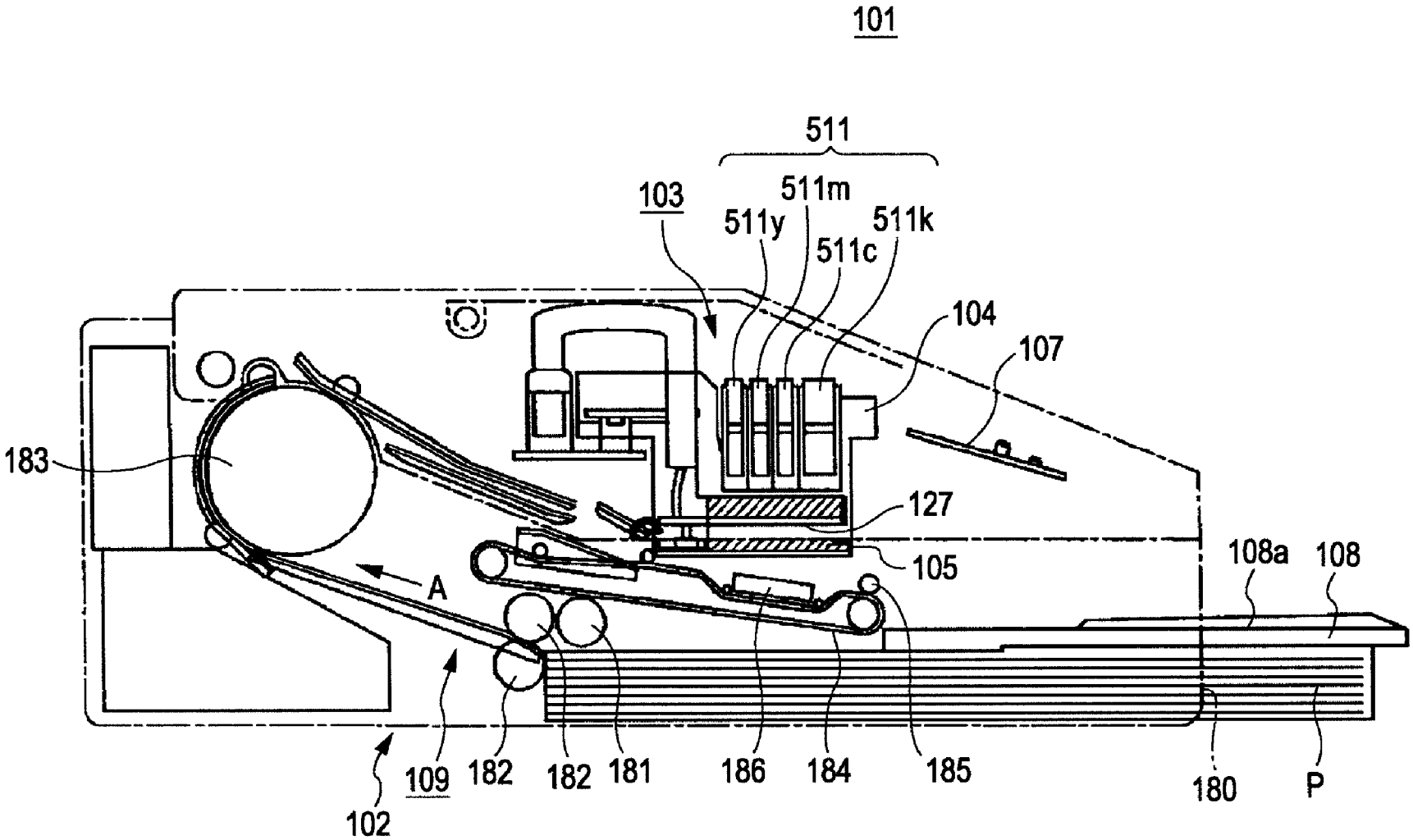
FIG. 12 is a side view showing an internal structure of the inkjet printer.

Then, the sheet feed/discharge mechanism 109 for feeding the recording sheet p from the recording sheet tray 108 to the printer body 102 and discharging the printed recording sheet p to the recording sheet tray 108 will be described with reference to FIG. 12. By mounting the recording sheet tray 108 for feeding the recording sheet p to the sheet feed/discharge mechanism 109 in the tray mount opening 180 provided on the front bottom surface of the printer body 102, the recording sheet p accommodated in the tray can be fed in the printer body 102. The recording sheet tray 108 is also provided with a sheet discharge tray 108*a* formed on the top surface for discharging the recording sheet p printed by the inkjet printer 101 thereon.

The sheet feed/discharge mechanism 109 includes the feed roller 181 for feeding the recording sheet accommodated in the recording sheet tray 108 in the printer body 102, separation rollers 182 for separating the recording sheet one by one, the inversion roller 183 for inverting the conveying direction of the recording sheet p toward the liquid ejection head 104, a conveying belt 184 for conveying the recording sheet p from the liquid ejection head 104 to the front of the printer body 102, and a discharge roller 185 for discharging the printed recording sheet p to the sheet discharge tray 108*a*.

The feed roller 181 takes the raw recording sheet p out of the recording sheet tray 108 so as to feed it to the back side of the printer body 102. A pair of the separation rollers 182 are provided in the vicinity of the feed roller 181 downstream in the conveying direction of the recording sheet p for taking out only one sheet of the recording sheets p to feed it to the inversion roller 183. The inversion roller 183 inverts the conveying direction of the recording sheet p conveyed to the back of the printer body 102 so as to convey the recording sheet p below the liquid ejection head 104. The conveying belt 184 is located under the liquid ejection head 104 for holding the recording sheet p below the liquid ejection head 104 and for feeding the printed recording sheet p from under the liquid ejection head 104 to the front of the printer body 102. The discharge roller 185 discharges the recording sheet p onto the sheet discharge tray 108*a* provided on the top surface of the recording sheet tray 108.

Although details are omitted, the inkjet printer 101 is provided with a circulating pump mechanism for circulating the ink i between the cartridge tank 512 and the liquid ejection head 104. The circulating pump mechanism is for removing air bubbles entrained in the liquid ejection head 104 in order to prevent printing quality from being deteriorated due to the bubbles. In such a circulating pump mechanism, the cartridge tank 512 and an ink flow path 131 formed in the liquid ejection head 104 are connected together via a circulating pump with an ink circulating pipe such as a resin tube. The ink circulating pipe is connected to both ends of the ink flow path 131 for each color, i.e., both ends of the common ink flow path 131 formed along the longitudinal direction of the liquid ejection head 104, and is also connected to both ends of the cartridge tank 512 in the longitudinal direction. The circulating pump provided in the mid flow of the ink circulating pipe for pressurizing the ink i so as to be circulated between the ink flow path 131 and the cartridge tank 512, and a diaphragm pump is used for example.

At the start of driving the inkjet printer 101 or before the start of printing, such a circulating pump mechanism is driven so as to suck the ink i from the ink flow path 131 and to discharge it to the cartridge tank 512 with the circulating pump. At this time, in the liquid ejection head 104, ink flows from the center to both ends of the ink flow path 131, so that air bubbles existing in the ink flow path 131 are thrust toward both ends so as to flow into the cartridge tank 512 and exhausted from an external communication hole 115. Thereby, the circulating pump mechanism can remove air bubbles contained in the ink i.

As described above, a line head type printer has been exemplified; however, the present invention is not limited to this, so that a serial head type printer may also be incorporated in that an ink ejection head moves in a direction substantially perpendicular to the traveling direction of the recording sheet p.

Also, it has been described that the ink cartridge 511 is mounted in the inkjet printer 101; however, the present invention is not limited to this example, so that the ink cartridge 511 may be widely mounted to other liquid ejection apparatuses. For example, liquid cartridges may be incorporated for supplying liquid to a facsimile machine, a copying machine, an ejection apparatus for a DNA chip solution (Japanese Unexamined Patent Application Publication No. 2002-253200), a liquid ejection apparatus for ejecting liquid containing conductive particles for forming wiring patterns of a printed circuit board.

It should be understood by those skilled in the art that various modifications, combinations, sub-combinations and alterations may occur depending on design requirements and other factors insofar as they are within the scope of the appended claims or the equivalents thereof.

What is claimed is:

1. A cleaning device comprising:

a liquid ejection head including a liquid ejection surface having liquid ejection nozzles arranged thereon for ejecting liquid;

a wiping member selectively moveable into sliding contact with the liquid ejection surface for wiping the liquid ejection surface;

a sucking member selectively moved to roll across the liquid ejection surface for sucking residual liquid in the liquid ejection nozzles;

a movement mechanism for independently moving the wiping member and the sucking member relative to the liquid ejection head liquid ejection surface; and further wherein the wiping member and sucking member are secured to a cap member that selectively covers and encloses the liquid ejection head, the wiping member and sucking member moving with the cap member across the liquid ejection head.

2. The device according to claim 1, further wherein the movement mechanism moves the wiping member and the sucking member relative to the liquid ejection head by moving the cap member relative to the liquid ejection head in opening and closing directions.

3. The device according to claim 2, wherein the wiping member is arranged adjacent to the sucking member with a changeover member therebetween, so that the wiping member and the sucking member share the changeover member, the changeover member mechanically interacting with the wiping member and sucking member to selectively engage the wiping member and sucking member.

4. The device according to claim 1, wherein at the start of liquid ejecting, the sucking member rolls on the liquid ejection surface while the wiping member is retracted from the liquid ejection surface, and at the completion of liquid ejecting, the sucking member is retracted from the liquid ejection surface while the wiping member wipes the liquid ejection surface.

5. The device according to claim 1, wherein the wiping member and the sucking member include a columnar cleaning roller made of an elastic and porous material, wherein by rotating or stopping to rotate the cleaning roller so as to have a speed difference relative to the moving speed by the movement mechanism, the cleaning roller is slidably engaged with the liquid ejection surface so as to wipe the liquid ejection surface, and wherein by rolling the cleaning roller on the liquid ejection surface according to the movement of the movement mechanism so as to suck liquid remaining in the liquid ejection nozzles.

6. The device according to claim 1, wherein the sucking member is soaked in a non-volatile solvent including at least an interfacial active agent.

7. The device according to claim 1, wherein the liquid ejection head is provided with a circulating pump for circulating liquid to and from a tank for supplying the liquid to the liquid ejection head.

8. A cleaning device comprising:

a liquid ejection head including a liquid ejection surface having liquid ejection nozzles arranged thereon for ejecting liquid;

a wiping member selectively moveable into sliding contact with the liquid ejection surface for wiping the liquid ejection surface:

a sucking member selectively moved to roll across the liquid ejection surface for sucking residual liquid in the liquid ejection nozzles;

a movement mechanism for independently moving the wiping member and the sucking member relative to the liquid ejection head liquid ejection surface with a cap member, wherein the wiping member is supported to the cap member rotatably in the same direction as that of the cap member moving to open and close the liquid ejection head while being urged to rise straight with a spring at a position slidably engaged with the liquid ejection surface, wherein the sucking member is supported to the cap member rollably in the same direction as that of the cap member moving to open and close the liquid ejection head while being urged to a position slid on the liquid ejection surface with a spring, wherein the changeover member is supported to the cap member rotatably in the same direction as that of the cap member moving to open and close the liquid ejection head while being urged to rise straight with a spring at a position slidably engaged with the liquid ejection surface, and wherein by moving the cap member to open and close the liquid ejection head, the changeover member is abutted on the liquid ejection surface so as to incline in a direction opposite to that moving the cap member, and by pushing the wiping member or the sucking member, the wiping member or the sucking member is retracted from the liquid ejection surface.

9. The device according to claim 8, wherein the abutment surface of the changeover member to the liquid ejection surface is shaped in a circular arc.

10. The device according to claim 8, wherein a spindle of the changeover member for journaling the sucking member is shaped in a concave pressure surface.

11. The device according to claim 8, wherein a surface of the changeover member for pressurizing the sucking member is bulged in a circular arc.

12. A cleaning device comprising:

a liquid ejection head including a liquid ejection surface having liquid ejection nozzles arranged thereon for ejecting liquid;

a wiping member selectively moveable into sliding contact with the liquid ejection surface for wiping the liquid ejection surface:

a sucking member selectively moved to roll across the liquid ejection surface for sucking residual liquid in the liquid ejection nozzles;

a movement mechanism for independently moving the wiping member and the sucking member relative to the liquid ejection head liquid ejection surface with a cap member, wherein the wiping member includes a cleaning blade having a wiping unit made of an elastic piece to be slidably engaged with the liquid ejection surface and a holder for supporting the wiping unit rotatably in a moving direction relative to the liquid ejection surface, and wherein the sucking member includes a columnar cleaning roller made of an elastic and porous material.

* * * * *